US005640660A

United States Patent [19]

Takano et al.

[11] Patent Number: 5,640,660

[45] Date of Patent: Jun. 17, 1997

[54] IMAGE TRANSFERRING DEVICE FOR IMAGE FORMING EQUIPMENT

[75] Inventors: Satoshi Takano, Tokyo; Itaru Matsuda, Yokohama; Yuko Harasawa, Hayama, all of Japan

[73] Assignee: Ricoh Company, Ltd., Tokyo, Japan

[21] Appl. No.: 449,778

[22] Filed: May 24, 1995

Related U.S. Application Data

[63] Continuation of Ser. No. 6,521, Jan. 21, 1993, abandoned.

[30] Foreign Application Priority Data

| | | | |
|---|---|---|---|
| Jan. 22, 1992 | [JP] | Japan | 4-009125 |
| Mar. 30, 1992 | [JP] | Japan | 4-074366 |
| Nov. 30, 1992 | [JP] | Japan | 4-320937 |

[51] Int. Cl.[6] ..... G03G 15/16

[52] U.S. Cl. ..... 399/313

[58] Field of Search ..... 355/271, 273, 355/274, 275, 205, 206, 207; 430/126

[56] References Cited

U.S. PATENT DOCUMENTS

| | | | |
|---|---|---|---|
| 3,647,292 | 3/1972 | Weikel, Jr. . | |
| 3,830,589 | 8/1974 | Allen . | |
| 3,832,053 | 8/1974 | Goel et al. . | |
| 4,162,843 | 7/1979 | Inoue et al. . | |
| 4,220,699 | 9/1980 | Ishida et al. | 430/126 |
| 4,268,157 | 5/1981 | Ebi et al. | 430/126 X |
| 4,407,580 | 10/1983 | Hashimoto et al. | 355/275 |
| 4,411,977 | 10/1983 | Tarumi et al. | 430/126 |
| 4,916,547 | 4/1990 | Katsumata et al. . | |
| 4,931,839 | 6/1990 | Tompkins et al. | 355/277 |

(List continued on next page.)

FOREIGN PATENT DOCUMENTS

| | | | |
|---|---|---|---|
| 0442527 | 8/1991 | European Pat. Off. . | |
| 3908488 | 9/1989 | Germany . | |
| 4040962A1 | 6/1991 | Germany . | |
| 56-069653 | 6/1981 | Japan . | |
| 59-65866 | 4/1984 | Japan . | |
| 1-292378 | 11/1989 | Japan . | |
| 0046477 | 2/1990 | Japan . | |
| 2-110586 | 4/1990 | Japan . | |
| 3-062077 | 3/1991 | Japan . | |
| 3-167579 | 7/1991 | Japan . | |
| 3-186876 | 8/1991 | Japan . | |
| 3-231273 | 10/1991 | Japan . | |
| 3-231783 | 10/1991 | Japan . | |
| 0231274 | 10/1991 | Japan | 355/275 |
| 0121767 | 4/1992 | Japan . | |

*Primary Examiner*—Robert Beatty

*Attorney, Agent, or Firm*—Oblon, Spivak, McClelland, Maier & Neustadt, P.C.

[57] ABSTRACT

An image transferring device incorporated in an image forming apparatus and capable of surely preventing a sheet from wrapping around a photoconductive element and from being incompletely separated from a transfer belt. A transfer bias and discharge are effected to prevent changes in the resistances of the transfer belt and sheet ascribable to changes in environment from translating into changes in a current to flow to the photoconductive element, and to efficiently dissipate a charge deposited on the belt. Various members constituting the device are positioned relative to one another such that the discharging effect is achievable most effectively while preventing the transfer bias from causing dielectric breakdown in any constituent part. For example, if a discharge member is spaced from a transfer electrode by $L_3$ and if the transfer electrode is spaced from a nip portion between the transfer belt and image bearing member by a distance $L_2$, than $L_3 \geqq L_2$. Additionally, if the vokage applied to the transfer electrode is $V_O$, than $L_2 \geqq a|V_O|$, where a is 1.0 (mm/kv); if a distance between the nip and an upstream roller entraining the belt is $L_1$, than $L_1 \geqq a|V_O|$; and if the distance between to discharge members is $L_4$, the transfer belt has a time constant of $\tau$, and a process speed is $\nu$, than $\tau \leqq L_4/\nu$. Finally, the transfer belt has a double layer structure made up of an outer layer having a surface resistivity of $1\times10^9$ to $1\times10^{12}$ Ω and an inner layer having a surface resisitivity of $8\times10^6$ to $8\times10^8$ Ω and a volume resisitivty of $5\times10^8$ to $5\times10^{10}$ Ωcm.

49 Claims, 13 Drawing Sheets

U.S. PATENT DOCUMENTS 4,984,024 1/1991 Ohkaji et al. .
5,040,028 8/1991 Kamimura et al. ..... 355/275
5,053,827 10/1991 Tompkins et al. ..... 355/271
5,138,363 8/1992 Yuge ..... 355/275 X
5,140,376 8/1992 Gotoda et al. ..... 355/274
5,148,224 9/1992 Yamada et al. ..... 355/271
5,153,653 10/1992 Fuma et al. .
5,172,173 12/1992 Goto et al. .
5,182,598 1/1993 Hara et al. .
5,189,479 2/1993 Matsuda et al. .
5,198,863 3/1993 Goto et al. ..... 355/274
5,268,725 12/1993 Koga et al. ..... 355/275
5,291,253 3/1994 Kumasaka et al. .
5,300,984 4/1994 Fuma et al. .
5,386,274 1/1995 Sanpe et al. .

IMAGE TRANSFERRING DEVICE FOR IMAGE FORMING EQUIPMENT

This application is a continuation of application Ser. No. 08/006,521, filed on Jan. 21, 1993, now abandoned.

BACKGROUND OF THE INVENTION

The present invention relates to an image transferring device for a copier, printer or similar electrophotographic image forming equipment and, more particularly, to a positional relation between a transfer bias section and a discharge section with respect to a sheet and control over the transfer bias in an image transferring device of the type transferring an image from an image carrier to a transfer belt while transporting the sheet and causing it to electrostatically adhere to the belt.

It is a common practice with image forming equipment to use an image transferring device of the type electrostatically transferring a toner image formed on an image carrier, or photoconductive element, to a sheet carried on a transfer belt to which an electric field opposite in polarity to the toner image is applied. This type of device usually includes an arrangement for applying a transfer bias to the transfer belt. For example, an electrode member is connected to a high-tension power source and held in contact with the rear of the belt at an image transfer position. Such an arrangement is advantageous over one which relies on a corona charger since it does not produce harmful ozone and can operate with a low voltage.

In addition to transferring a toner image from the photoconductive element to the sheet, the device with the above-stated bias arrangement deposits a polarized charge on the sheet by the transfer bias so as to cause the sheet to electrostatically adhere to the belt. Therefore, as the belt is moved, the sheet can be transported by the belt and separated from the belt due to the electrostatic adhesion.

However, when the sheet is caused to electrostatically adhere to the belt, it has to be separated from the belt after image transfer. For the separation of the sheet, use may be made of a transfer belt having a resistance of $10^{10}.\Omega.cm$ to $10^{13}.\Omega.cm$, and a discharge member located downstream of an image transfer position with respect to an intended direction of movement of the belt for dissipating the charge of the belt, as disclosed in Japanese Patent Laid-Open Publication No. 83762/1988 by way of example. The discharge member reduces or cancels the charge of the sheet to promote easy separation of the sheet. Regarding the discharge of the belt, Japanese Patent Laid-Open Publication No. 96838/1978, for example, teaches an arrangement which uses a transfer belt having a resistance of $10^8$ Ω.cm to $10^{13}$ Ω.cm and, in the event of continuously transferring images from a plurality of photoconductive elements to a sheet carried on the belt, dissipates a charge of the belt deposited by a discharge ascribable to the separation of the sheet from one photoconductive element before the belt faces the next element.

On the other hand, when the transfer bias is maintained constant, a current to flow to the photoconductive element changes relative to the bias set at the transfer belt side due to changes in temperature, humidity and other environmental conditions. For example, in a high temperature and high humidity environment, an excessive current is apt to flow to the photoconductive element since the belt and sheet absorb moisture to lower their resistances. This increases the charge deposited on the photoconductive element and often causes the sheet to wrap around the element. In the opposite environment, the transfer of a toner image becomes defective. In the light of this, use may be made of control circuitry having a controller for controlling the output current of a high-tension power source and to which a roller which supports the belt is connected, as taught in, for example, Japanese Patent Laid-Open Publication No. 231274/1991. The control circuitry detects the output current of the power source by the support roller via the belt and controls the output current in matching relation to a feedback current flowing through the support roller. With such control circuitry, it is possible to maintain the current to flow to the drum constant and thereby prevent the sheet from wrapping around the drum while eliminating defective image transfer.

However, simply selecting an electric characteristic with regard to the belt is not satisfactory when the transfer bias or the discharging operation is to be set as stated above. Particularly, it is necessary to eliminate the wrapping of the sheet, defective image transfer and incomplete sheet separation by adequately positioning the constituents of the image transfer device relative to each other and selecting adequate materials at the actual design stage. Moreover, for the control of the surface potential of the sheet via the belt, not only changes in environment but also other factors, e.g., changes in surface potential ascribable to changes in resistance which are in turn ascribable to irregularities in the quality of belts particular to the production line and the size of an image have to be taken into account. Should such changes be neglected, the amount of charge for setting up an electric field required for image transfer would change. This would not only degrade the quality of an image but also aggravate the defective sheet separation.

SUMMARY OF THE INVENTION

It is, therefore, an object of the present invention to provide an image transferring device for an image forming apparatus which surely prevents a sheet from wrapping around a photoconductive element and from being incompletely separated from a transfer belt.

In accordance with the present invention, a device incorporated in an image forming apparatus for transferring an image from a photoconductive element to a sheet comprises a transfer belt made of a dielectric material and contacting the surface of the photoconductive element, a support supporting a drive roller and a driven roller over which the transfer belt is passed, a sheet transport member for transporting the sheet to between the photoconductive element and the transfer belt, and a contact electrode connected to a high-tension power source and directly contacting the transfer belt in the vicinity of the photoconductive element. Assuming that a distance between the driven roller adjoining the photoconductive element and a nip portion where the photoconductive element and the transfer belt face each other is $L_1$, and that a voltage to be applied from the high-tension power source to the contact electrode is $V_O$, the distance $L_1$ is selected to satisfy a relation:

$$L_1 \geqq \alpha \times |V_O|$$

where α is 1.0 (mm/kV).

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
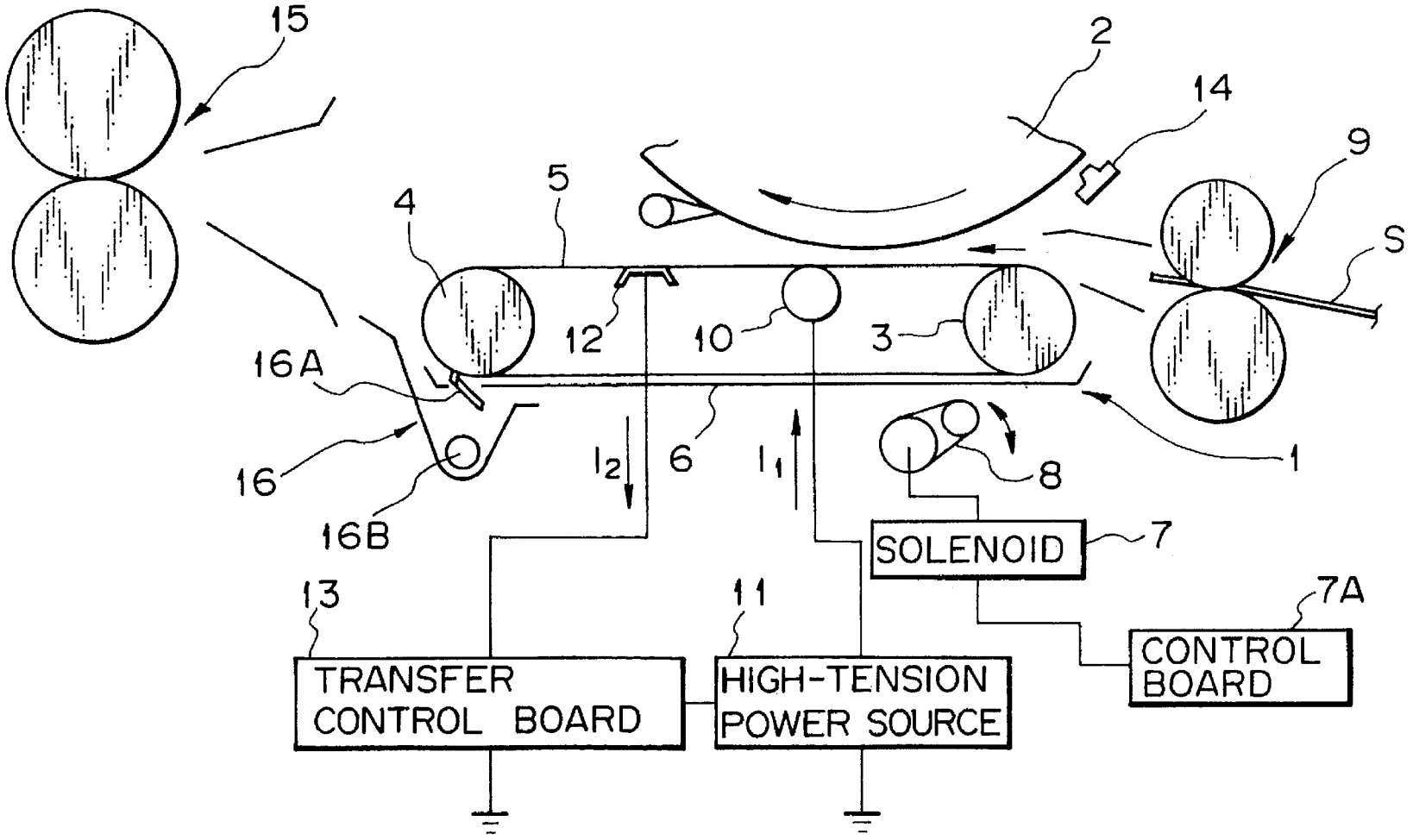
FIG. 1 is a section showing the general construction of an image transferring device embodying the present invention.
Figure 3:
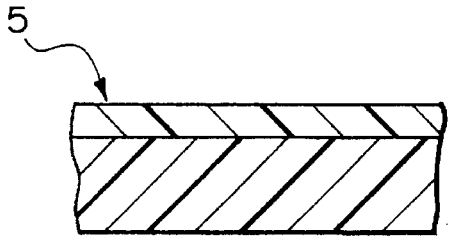
FIG. 3 is a section of a transfer belt included in the embodiment.

Referring to FIG. 1 of the drawings, an image transferring device for image forming equipment embodying the present invention is shown and generally designated by the reference numeral 1. As shown, the device 1 has a transfer belt 5 passed over a pair of rollers 3 and 4. An image is formed on a photoconductive drum 2 and transferred to a sheet S carried on the belt 5. Specifically, as the roller, or drive roller, 4 is rotated, the belt 5 is moved in a direction for transferring the sheet S (indicated by an arrow in the Figure) at a position where it faces the drum 2. As shown in FIG. 3, the belt 5 has a double layer structure, i.e., an outer or surface layer and an inner layer. The surface layer has an electric resistance of $1\times10^{9}$ Ω to $1\times10^{12}$ Ω as measured at the surface of the belt 5. The inner layer has a surface resistivity of $8\times10^{6}$ Ω to $8\times10^{8}$ Ω and a volume resistivity of $5\times10^{8}$.Ω.cm to $5\times10^{10}$ Ω.cm.

The rollers 3 and 4 are rotatably supported by a support 6. The support 6 is angularly movable about a position where it supports the drive roller 4 which is located downstream of a transfer position with respect to the direction of sheet feed. A solenoid 7 is operated by a control board 7A to actuate the side of the support 6 adjoining the transfer position side of the belt 5. Specifically, a lever 8 is connected to the solenoid 7 to move the support 6 into and out of contact with the drum 2. Sheet transporting means in the form of a register roller 9 drives the sheet S toward the drum 2 in synchronism with an image formed on the drum 2. As the leading edge of the sheet S approaches the drum 2, the support 6 is moved toward the drum 2. As a result, the belt 5 is brought into contact with the drum 2 to form a nip portion B, FIG. 2, where it can transport the sheet S while urging the sheet S against the drum 2.

In the illustrative embodiment, the roller 3 closer to the drum 2 than the roller 4 is implemented as a driven roller made of metal or similar conductive material having a relatively great electric capacity. The conductive driven roller 3 is held in a floating state to eliminate discharge ascribable to charge-up. In this configuration, charges deposited on the roller 3 are dissipated via the belt 5 having the above-stated electric characteristic. The surface of the roller 3 is tapered in the axial direction to prevent the belt 5 from becoming offset. The drive roller 4 is made of an insulating material in order to eliminate a sharp migration of charge which would cause a discharge to occur in the event of separation of the sheet S from the belt 5, as will be described specifically later. For example, the roller 4 is made of insulating EP rubber or chloroprene rubber for the above purpose and, at the same time, for enhancing the gripping force which the roller 4 exerts on the belt 5.

A bias roller 10 is located upstream of the drive roller 4 with respect to the moving direction of the belt 5 and held in contact with the inner surface of the belt 5. Connected to a high-tension power source 11, the bias roller 10 constitutes a contact electrode for applying to the belt 5 a charge which is opposite in polarity to a toner deposited on the drum 2. A contact plate 12 is positioned downstream of the bias roller 10 and in such a manner as to face the sheet S with the intermediary of one of opposite runs of the belt 5 corresponding to the sheet transport surface of the belt 5. The contact plate 12 detects a current flowing through the belt 5 as a feedback current. The current to be fed from the bias roller 10 is controlled in response to the output of the contact plate 12. A transfer control board 13 is connected to the contact plate 12 to set a current to be applied to the bias roller 10 on the basis of the detected current. The transfer control board 13 is also connected to the high-tension power source 11. After the transfer operation the sheet S is discharged as shown at 15.

Figure 2:
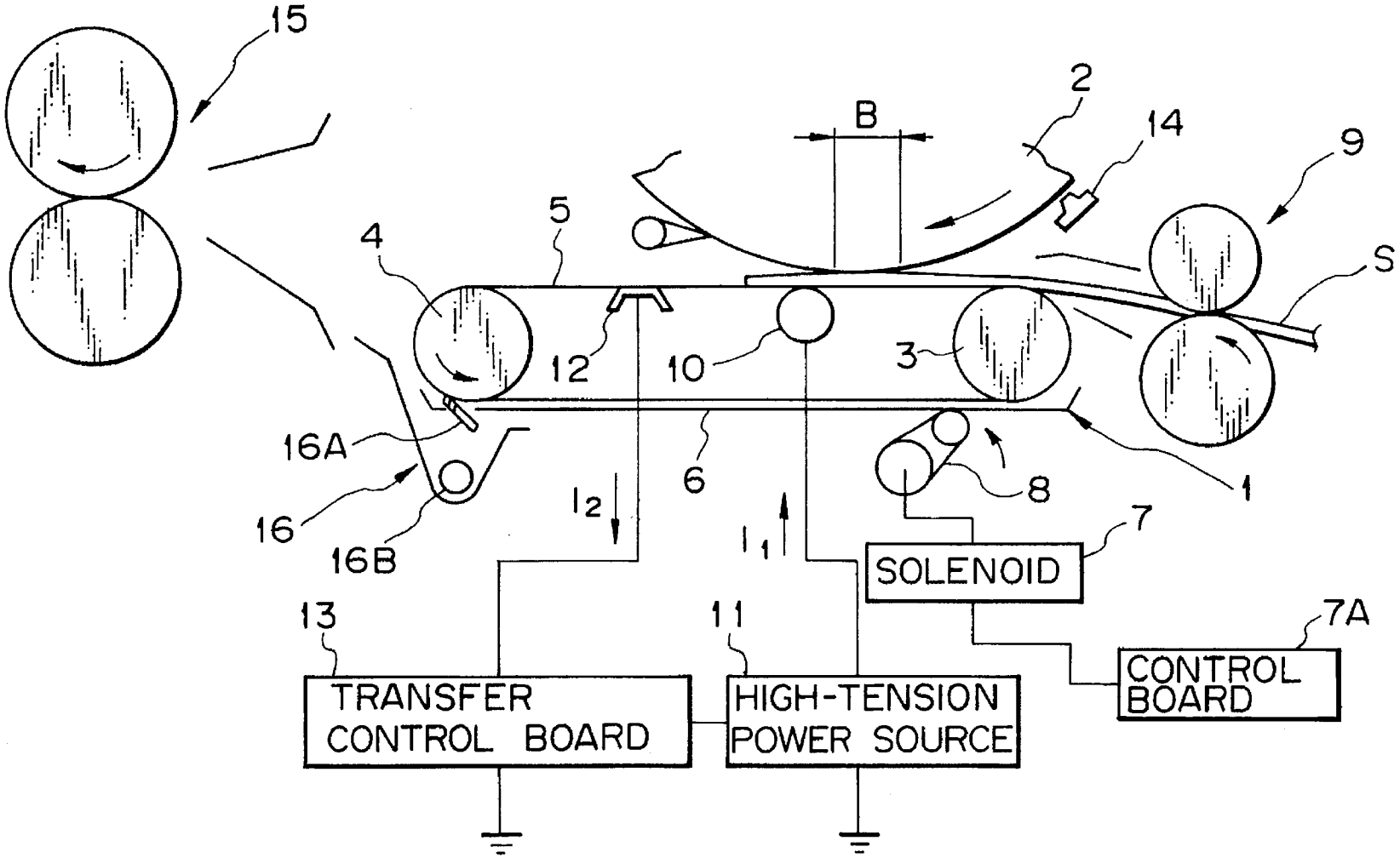
FIG. 2 demonstrates the operation of the embodiment for transferring an image.
Figure 4:
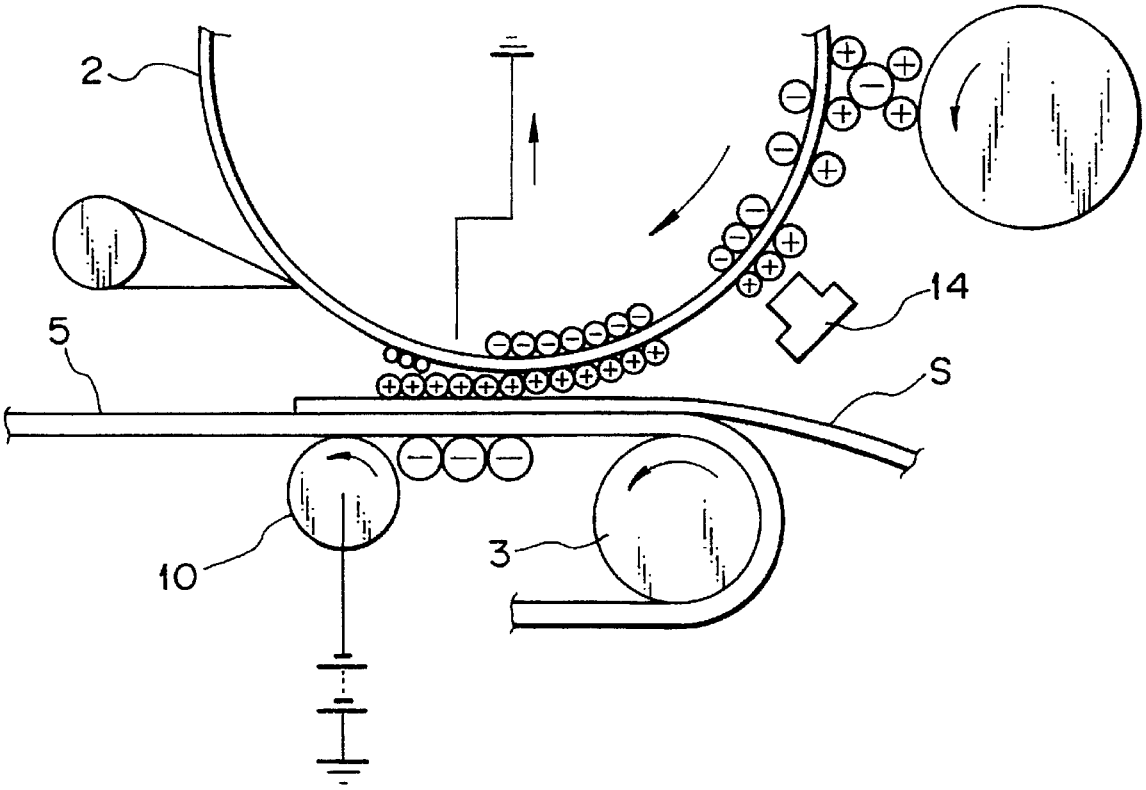
FIG. 4 is representative of a toner deposited on a photoconductive element included in the embodiment together with charges deposited on a sheet and the transfer belt for electrostatically transferring the toner.

In operation, as the sheet S is fed from the register roller 9, the support 6 and, therefore, the belt 5 is angularly moved toward the drum 2. Then, the belt 5 forms the nip portion B between it and the drum 2, as shown in FIG. 2. The nip portion B has a dimension of about 4 mm to about 8 mm in the direction of sheet transport. On the other hand, the drum 2 has the surface thereof charged to, for example, −800 V and electrostatically carries a toner thereon, as shown in FIG. 4. Before such a surface of the drum 2 reaches the nip portion B, the surface potential is lowered by a pretransfer discharge lamp 14. In FIG. 4, the size of a charge is represented by the diameter of a circle; charges lowered by the lamp 14 are represented by smaller circles. In the nip portion B, the toner on the drum 2 is transferred to the sheet S by the bias from the bias roller 10. In the embodiment, a voltage of −1.5 kV to −2.0 kV is applied to the bias roller 10, so that the potential of the belt 5 may range from −1.3 kV to −1.8 kV as measured in the nip portion B.

The above-mentioned potential of the belt 5 in the nip portion B is selected for the following reason. In FIGS. 1 and 2, assume that the output current of the power source 11 is $I_1$, and that the feedback current flown from the contact plate 12 to ground via the belt 5 is $I_2$. Then, the current $I_1$ is controlled to satisfy an equation:

$$I_1-I_2=I_{OUT} \quad \text{Eq. (1)}$$

where $I_{OUT}$ is constant. This is successful in stabilizing the surface potential $V_P$ of the sheet S and, therefore, in eliminating changes in transfer efficiency with no regard to temperature, humidity and other ambient conditions and irregularities in the quality of belts 5. More specifically, by considering that a current $I_{OUT}$ flows toward the drum 2 via the belt 5 and sheet S, it is possible to prevent the sheet separability and image transferability from being effected by changes in the easiness of current flow to the drum 2 which are ascribable to a decrease or an an increase in the surface potential $V_P$ of the sheet S.

As stated above, the potential of the belt 5 in the nip portion B is so set as to obtain the surface potential $V_P$ of the sheet S. In this connection, favorable image transfer was achieved when the $I_{OUT}$ was 35 μA plus 5 μA. It is to be noted that regarding the above-stated potential range of "−1.3 kV to −1.8 kV" of the belt 5, the surface potential of the sheet S may sometimes exceed the range, depending on the environment, the kind of sheet and/or the change in the resistance of the belt 5.

When an image is transferred from the drum 2 to the sheet S, the sheet S is also charged. Therefore, the sheet S can be electrostatically attracted onto the belt 5 and thereby separated from the drum 2 on the basis of the relation between the true charge on the belt 5 and the polarized charge on the sheet S. This is enhanced by the size of the transfer bias (higher than −3 kV) relative to the charge potential (−800 V) of the drum 2 and by, apart from the electrostatic relation, the elasticity of the sheet S using the curvature of the drum 2.

However, the electrostatic adhesion relying on a potential described above is not satisfactory since in a high humidity environment a current easily flows to the drum 2 to obstruct the separation of the sheet S. In the light of this, the surface layer of the belt 5, FIG. 2, is provided with a relatively high resistance so as to delay the shift of the true charge from the belt 5 to the sheet S in the nip portion B and, therefore, the flow of a current to the drum 2. In addition, the bias roller 10 is located downstream of the nip portion B in the direction of sheet transport. With this configuration, it is possible to eliminate the electrostatic adhesion of the sheet S and drum 2. To delay the shift of the true charge means to prevent a charge from depositing on the sheet S before the sheet S reaches the nip portion B. Hence, the sheet S is prevented from wrapping around the drum 2 or from being incompletely separated from the drum 2.

Also, the belt 5 should preferably be made of a material whose resistance is sparingly susceptible to changes in environment. For example, when the belt 5 is implemented as an elastic belt made of rubber, chloroprene or similar material having low hygroscopic property and stable resistance is more desirable than, for example, urethane rubber which is highly hygroscopic.

The current $I_{OUT}$ to flow to the drum 2 is not unconditionally selected. For example, the current $I_{OUT}$ may be reduced when the potential of the toner is low as in a digital system. Conversely, when the pretransfer discharge lamp is not used, the current $I_{OUT}$ may be increased in matching relation to an increase in the surface potential of the drum 2.

The sheet S passed the nip portion B is transported by the belt 5. During the transport, the electrostatic adhesion relation between the sheet S and the belt 5 is reduced or cancelled by the discharge effected by the contact plate 12. At this instant the rate or speed at which the charge deposited on the sheet S is reduced is dependent on the resistance of the sheet S and the electrostatic capacity. Specifically, assuming that the resistance of the sheet is R and the electrostatic capacitance is C, the rate is expressed as $$\tau(\text{time constant})=C\cdot R \qquad \text{Eq. (2)}$$

Hence, when the sheet S is implemented as an OHP sheet or has the resistance thereof increased due to high humidity, a substantial period of time is necessary for the charge deposited thereon to decrease. Such a sheet S is separated from the belt 5 by the curvature of the drive roller 4. For this purpose, the drive roller 4 is provided with a diameter less than 16 mm. Experiments showed that when use was made of such a drive roller, a high quality 45K sheet (rigidity: horizontal 21 ($cm^3$/100)) could be separated.

After the image transfer from the drum 2 to the sheet S and the separation of the sheet S, the solenoid 7 is deenergized to move the support 6 away from the drum 2. Then, the surface of the belt 5 is cleaned by a cleaning device 16 having a cleaning blade 16A. The cleaning blade 16A rubs the surface of the belt 5 to scrape off the toner transferred from the background of the drum 2 to the belt 5, the toner scattered around the belt 5 without being transferred, and paper dust separated from the sheet S. The belt 5 to be rubbed by the blade 16A is provided with a coefficient of friction low enough to eliminate an increase in required torque due to an increase in frictional resistance and to eliminate the deformation of the blade 16A. Specifically, in the embodiment, the surface of the belt 5 is covered with fluorine (vinylidene polyfluoride). The toner and paper dust removed from the belt 5 by the blade 16A is collected in a waste toner container, not shown, by a coil 16B.

The various members for setting the surface potential of the sheet S as described above are related in position. as follows. To begin with, assuming that the current $I_{OUT}$ is constant, a change in the current $I_1$ to the bias roller 10 causes the output voltage $V_O$ of the power source 11 to change, as indicated by the Eq. (1). Assume that when the output voltage $V_O$ has a maximum value $V_{max}$, the distance from the driven roller 3 to the nip portion B is $L_1$ while the output voltage $V_O$ is applied to the bias roller 10. Then, the distance $L_1$ is so selected as to satisfy a relation:

$$L_1 \geqq a \times |V_O| \qquad \text{Eq. (3)}$$

where a is 1.0 (mm/kV). Further, assuming that the distance from the nip portion B to the bias roller 10 is $L_2$, then the distance $L_2$ is determined to satisfy a relation:

$$L_2 \geqq a \times |VO| \qquad \text{Eq. (4)}$$

where α is 1.0 (mm/kV) Eq. (4).

Why the distances $L_1$ and $L_2$ are selected as stated above is as follows. Assume that the belt 5 is a dielectric body having the time constant τ. Then, as the bias roller 10 approaches the drum 2, e.g., reaches a position just below the drum 2 while the output voltage $V_O$ is high, dielectric breakdown is apt to occur in a conductor included in the drum 2. The distances $L_1$ and $L_2$ successfully eliminate such an occurrence.

Specifically, assuming that $L_1=L_2=1$ mm and $V_O=-3$ kV, then a leak occurs from the bias roller 10 to the drum 2 over the gap. The leak occurs at, for example, micropores and comparatively thin portions which may exist in the belt 5. The leak breaks the portion where it occurred, i.e., it forms macropores in the surface of the belt 5 and that of the drum 2. As a result, power for forming an electric field for image transfer is not used and, therefore, the electric field is not formed, making the image transfer defective. Moreover, a spark discharge ascribable to the leak is not desirable from the safety standpoint. This is also true with the driven roller 3 held in a floating state.

For the reasons described above, the embodiment selects a $V_{max}$ of −3 kV and distances $L_1$ and $L_2$ of 8 mm and 6 mm, respectively. It is to be noted that the value α is variable in matching relation to the output voltage $V_O$ and may be 2 or greater than 2.

Assuming that the distance from the bias roller 10 to the contact plate 12 is $L_3$, then the distance $L_3$ is related to the distance $L_2$, as follows:

$$L_3 \geqq L_2$$

This is because, to achieve $I_{OUT}$ efficiently, the distance $L_3$, i.e., the resistance of the belt 5 per unit area should be great enough to distribute $I_1$ in a relation of $I_{OUT}>I_2$. Specifically, assuming that the feedback current $I_2$ is zero, i.e., the contact plate 12 is absent, $I_1$ will be equal to $I_{OUT}$, providing 100% efficiency. However, since the entire surface of the belt 5 will have exactly the same potential as the output voltage $V_O$, electric noise will occur at the positions where the rollers contact the belt 5 and effect the control system to bring about errors.

Hence, a relation $I_1=I_{OUT}+I_2$ is derived from the previously stated relation $I_1-I_2=I_{OUT}$.

It will be seen from the above that the power source current ($I_1$) is determined by the sum of $I_{OUT}$ and $I_2$ and, therefore, $I_2$ should be as small as possible in order to use the power source for the image transfer purpose as efficiently as possible. On the other hand, when the resistance of the belt 5 remains the same, the current distribution is inversely proportional to the distances $L_2$ and $L_3$. Therefore, a relation $L_3 \geqq L_2$ should hold as far as possible. When an experiment was conducted with a relation $L_3>L_2$, the capacity of the power source and, therefore, the image transfer was found short. Further, since the power source is often built in a unit, the capacity thereof, i.e., the space for accommodating it cannot be increased beyond a certain limit. In this respect, too, the contact plate 12 for controlling the potential of the belt 5 and the abovementioned positional relation are indispensable.

Figure 5:
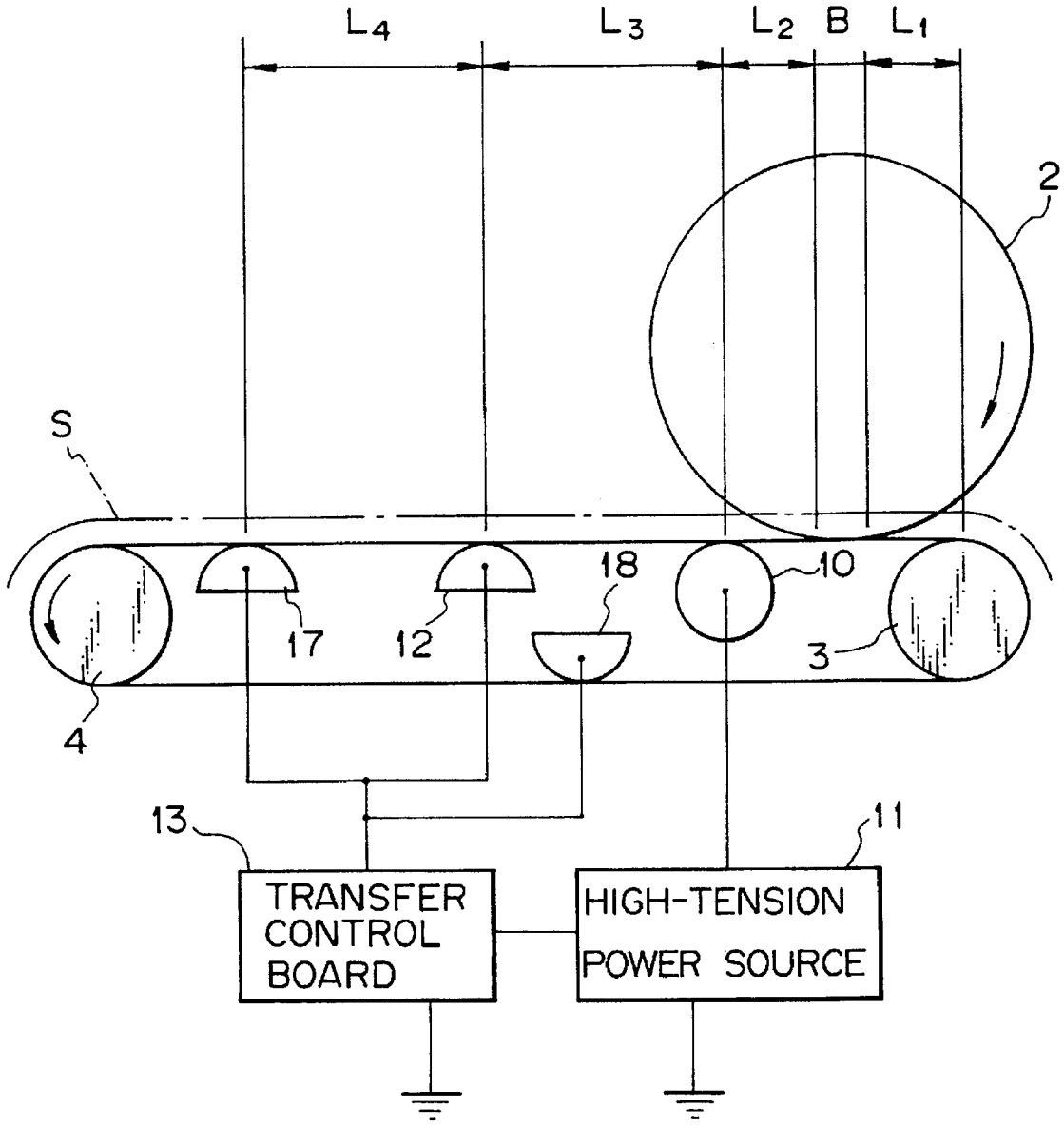
FIG. 5 is indicative of a positional relation of a driven roller, a bias roller and contact plates included in the embodiment.

As shown in FIG. 5, a second contact plate 17 may be located downstream of the contact plate 12 in the direction of sheet transport. In such a case, the contact plates 12 and 17 are spaced apart by a distance $L_4$ which insures the discharge of the belt 5 having the time constant $\tau=C\cdot R$. The distance $L_4$ depends on the process speed v of the belt 5 and is selected to satisfy a relation:

$$\tau \leqq L_4/v$$

In this case, τ indicates a period of time necessary for the belt 5 to be discharged, as counted from the time when the belt 5 has moved away from the first contact plate 12.

Specifically, considering the separation of the sheet from the belt 5, it is necessary to surely discharge the belt 5. When the belt 5 moved away from the second contact plate 17 is not fully discharged, the discharge of the belt 5 over the distance from the contact plate 17 and the separation position solely depends on the time constant of the belt 5. Therefore, only if the discharge depending on the time constant of the belt 5 is completed when the belt 5 has moved away from the contact plate 17, the belt 5 will be fully discharged. Such a relation is also desirable when the linear velocity (process speed) of the belt 5 is taken into account.

Figure 6:
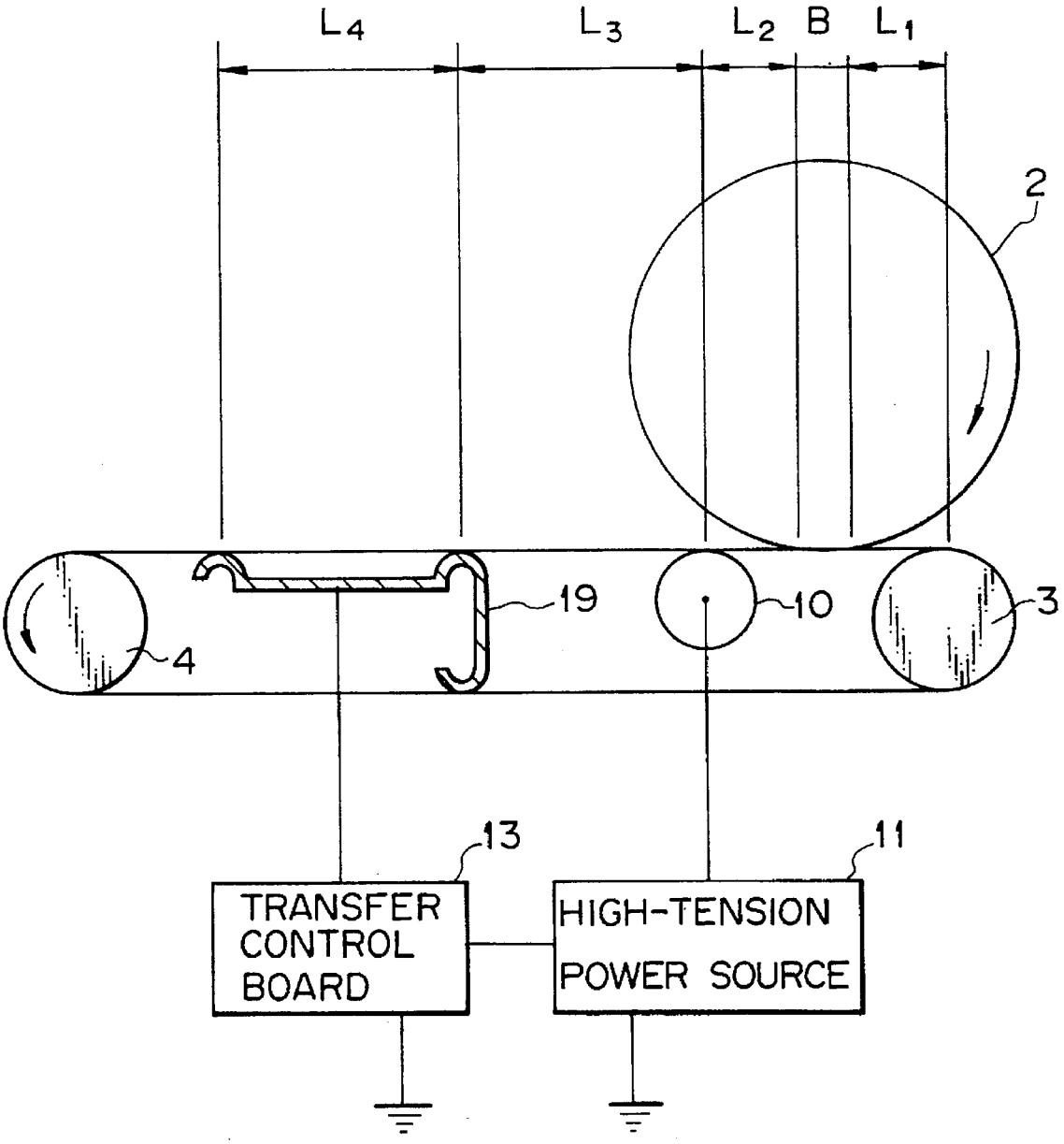
FIG. 6 shows a modified configuration of the contact plates of FIG. 5.
Figure 7:
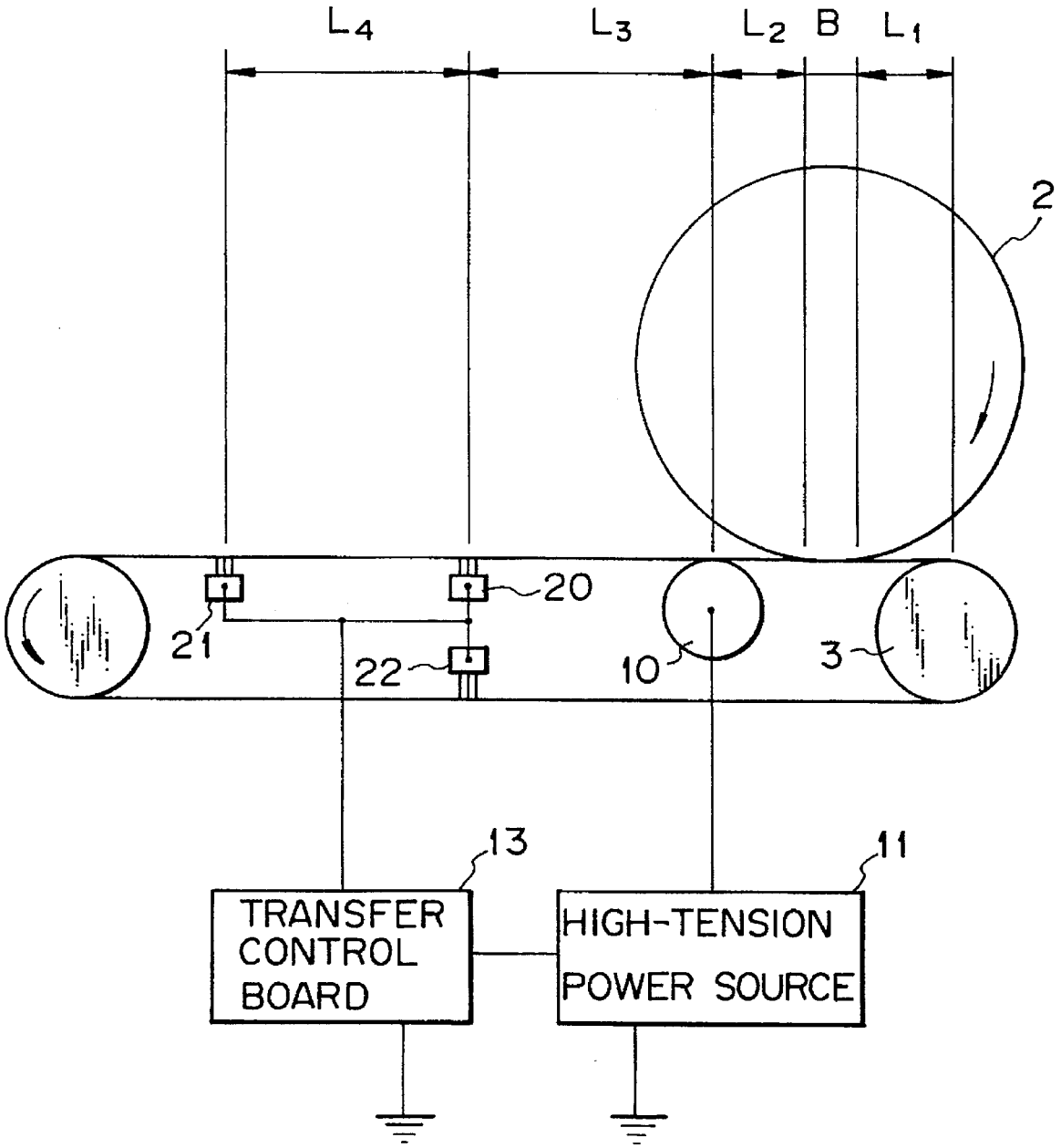
FIG. 7 shows another specific configuration of the contact plates of FIG. 5.

As also shown in FIG. 5, a third contact plate 18 may be held in contact with the inner surface of the lower run of the belt 5 which is opposite to the upper run for carrying the sheet S. The contact plate 18 serves the same function as the other contact plates 12 and 17. As shown in FIG. 6, the contact plates 12, 17 and 18 may be implemented as a single contact member 19 formed of a sheet metal, if desired. Further, as shown in FIG. 7, the contact plates 12, 17 and 18 may be respectively constituted by conductive brushes 20, 21 and 22 in order to reduce the contact resistance.

A reference will be made to FIGS. 8–14 for describing specific arrangements for preventing the current to flow to the photoconductive element from changing due to a change in the resistance of the transfer belt, a change in the property of the sheet, etc.

Figure 8:
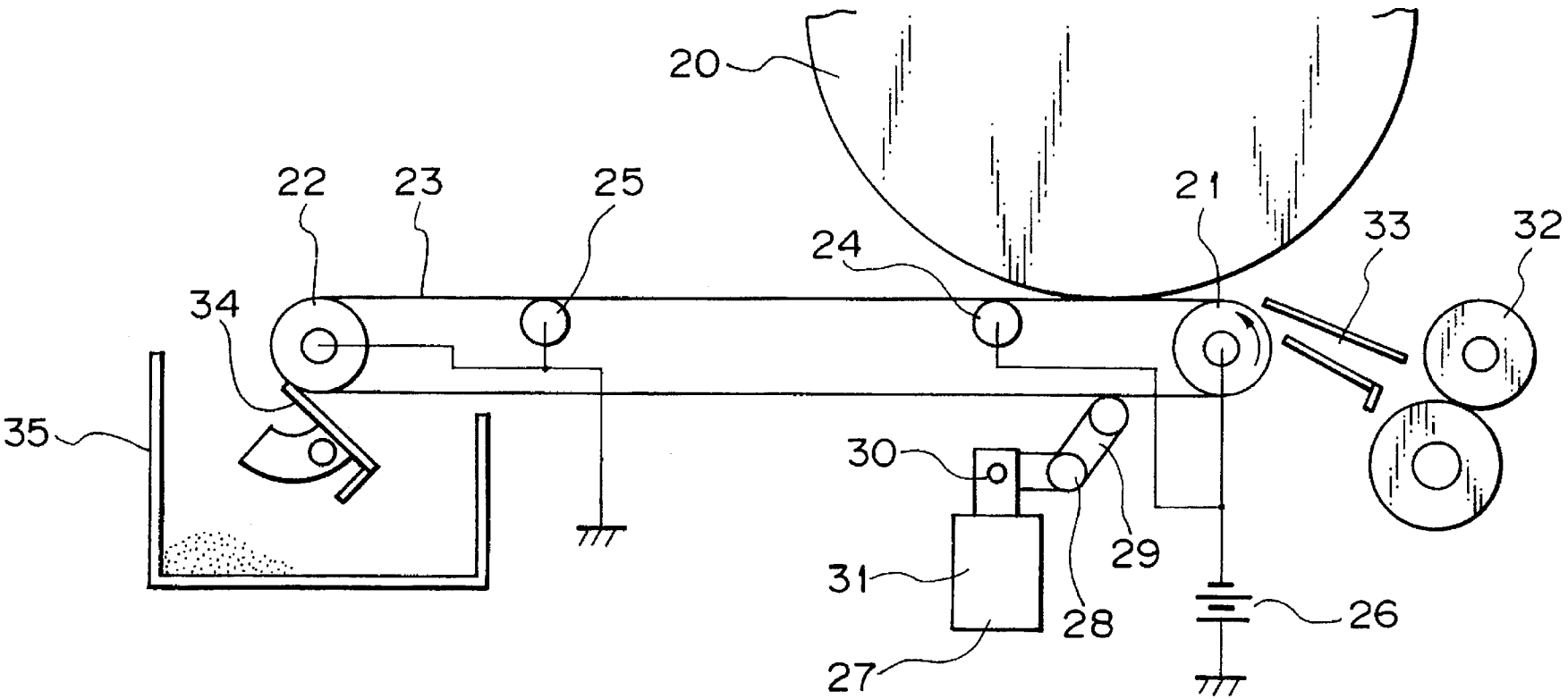
FIG. 8 shows a specific arrangement for maintaining a difference between a current to flow to the transfer belt and a current to flow to ground constant.

In FIG. 8, a photoconductive drum, or image carrier, 20 is rotatable. Arranged around the drum 20 are a discharger for discharging the drum 20, a charger for charging the drum 20, an exposing section for forming an electrostatic latent image on the drum 20 by light, a cleaning unit for cleaning the drum 20 and other conventional process units, although not shown in the figure. A transfer belt 23 is disposed below the drum 20 and passed over a conductive drive roller 21 and a conductive driven roller 22. The upper run of the belt 23 is supported by conductive rollers 24 and 25 from the rear. The drive roller 21 i s connected to a motor, not shown, and rotated in a direction indicated by an arrow in the figure. The rollers 21 and 24 are connected to a power source 26 to play the role of contact electrodes contacting the belt 23. The roller or contact electrode 24 is located downstream of a nip portion between the drum 20 and the belt 23 with respect to an intended direction sheet transport. Specifically, the roller 24 is positioned such that a charge is not injected into a sheet before the sheet reaches a position where it faces the drum 20, as in the arrangement of FIG. 1. Again, this is successful in preventing a sheet from wrapping around the drum 20. The other rollers 22 and 25 are connected to ground. The belt 23 is formed of a dielectric material having a resistance of $10^6$ Ω to $10^{12}$ Ω, particularly 9 to $9.4\times10^7$ Ω in the embodiment.

The belt 23 is selectively brought into or out of contact with the drum 20 by a mechanism 27 including a lever 29 and a solenoid 31. The lower end of the lever 29 is rotatably connected to a plunger 30 extending out from the solenoid 31. The lever 29 supports the belt 23 at the upper end thereof and is rotatable about a shaft 28. A sheet guide 33 extends from a register roller, or sheet transporting means, 32 to the drive roller 21. A cleaning blade 34 is disposed in a top-open waste toner container 35 and urged against the driven roller 22 with the intermediary of the belt 23 to remove a toner remaining on the belt 23.

Figure 9:
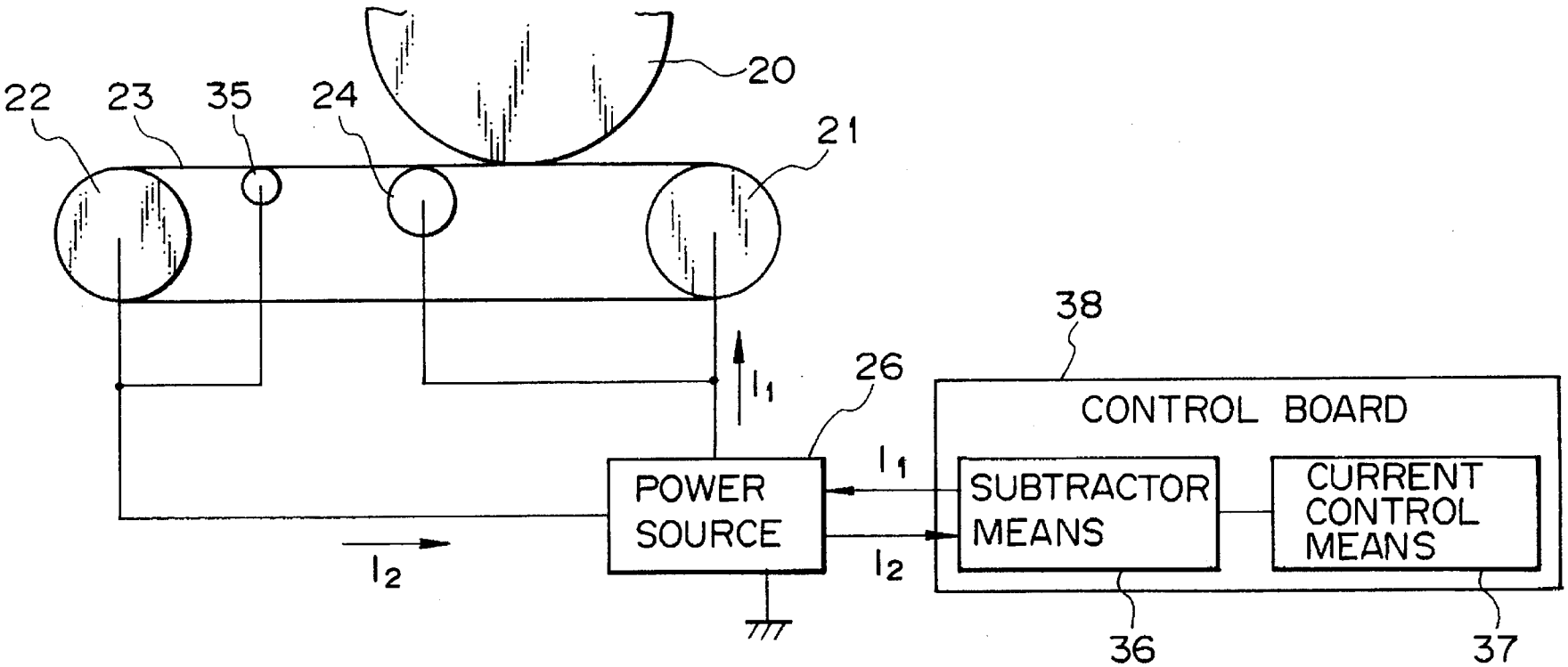
FIG. 9 is a schematic block diagram associated with FIG. 8.

As shown in FIG. 9, assume that a current $I_1$ is fed from the power source 26 to the belt 23 via the drive rollers or contact electrodes 21 and 24, and that a current $I_2$ flows from the belt 23 to ground via the rollers 22 and 25. A control board 38 includes subtractor means 36 and current control means 37. The subtractor means 36 subtracts the current $I_2$ from the current $I_1$. The controller 37 controls the current from the power source 26 to the rollers 21 and 24 such that the residual produced by the subtractor means 36 remains constant, i.e., at 30 μA in this case.

In operation, a sheet, not shown, is brought to a stop at the nip portion of the register roller 32 and then driven to between the drum 20 and the belt 23 in synchronism with the rotation of the drum 20. At this instant, the solenoid 31 is energized to cause the lever 29 to bring the belt 23 into contact with the drum 20. In FIG. 9, a current is fed from the power source 26 to the dielectric belt 23 via the rollers 21 and 24 while the belt 23 is driven by the roller 21 to transport the sheet to the left. Since the belt 23 has a resistance of 9 to $9.4\times10^7$ Ω, as stated earlier, the current is prevented from being immediately flowing to ground. Hence, a charge required for image transfer can be deposited on the belt 23 in the vicinity of the drum 20. In addition, the current control means 37 controls the current to the belt 23 such that the difference between the current $I_1$ to the belt 23 and the current $I_2$ to ground remains constant, as also stated previously. It follows that although the resistance of the belt 23 may change, the current to flow from the belt 23 to the drum 20 remains constant to in turn maintain the charge required for image transfer substantially constant between the drum 20 and the belt 23. As a result, the quality of a transferred image is enhanced.

Figures 10A, 10B:
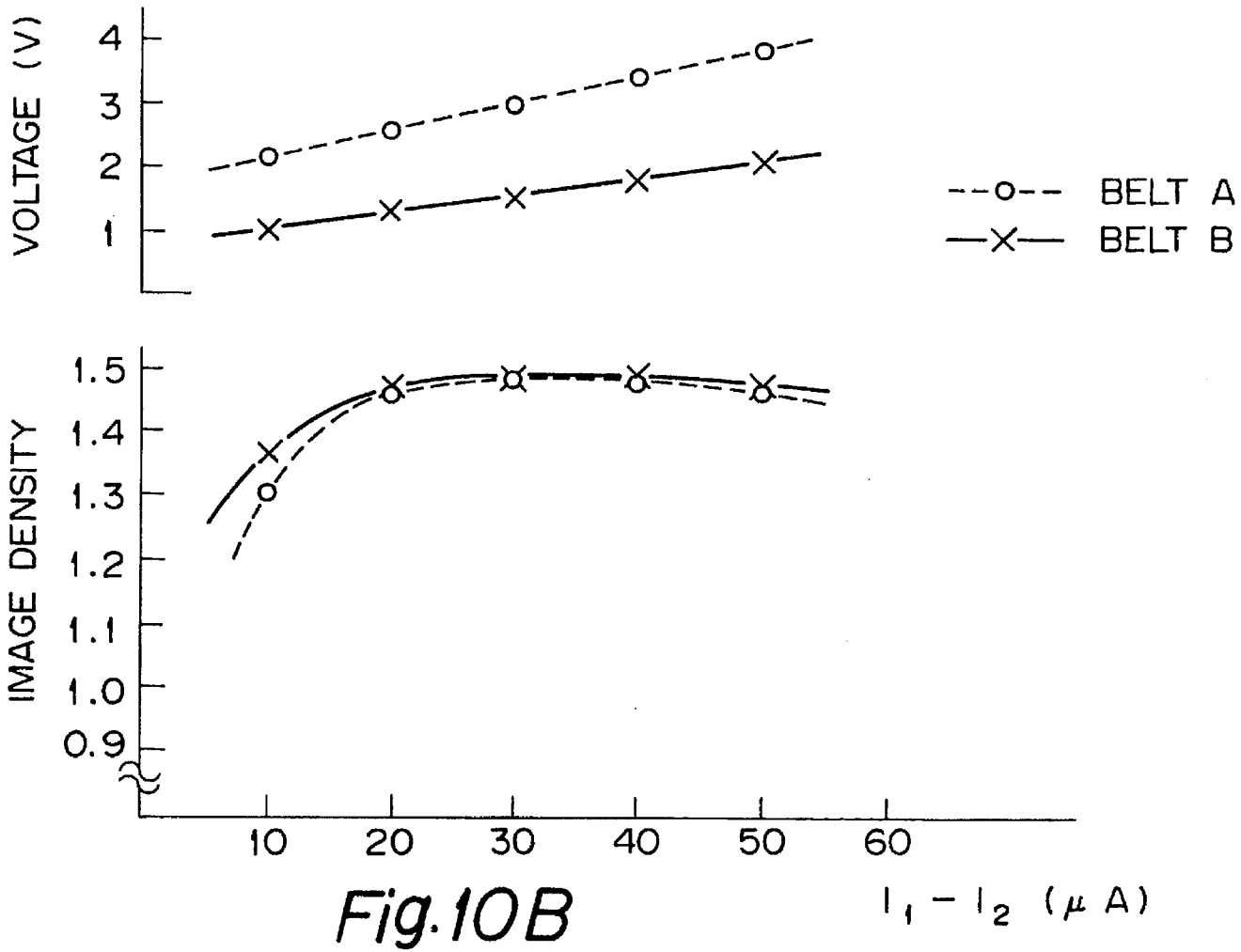
FIG. 10 plots a relation between a current and a voltage and image density with respect to different transfer belts and particular to the arrangement of FIG. 8.
Figures 11A, 11B:
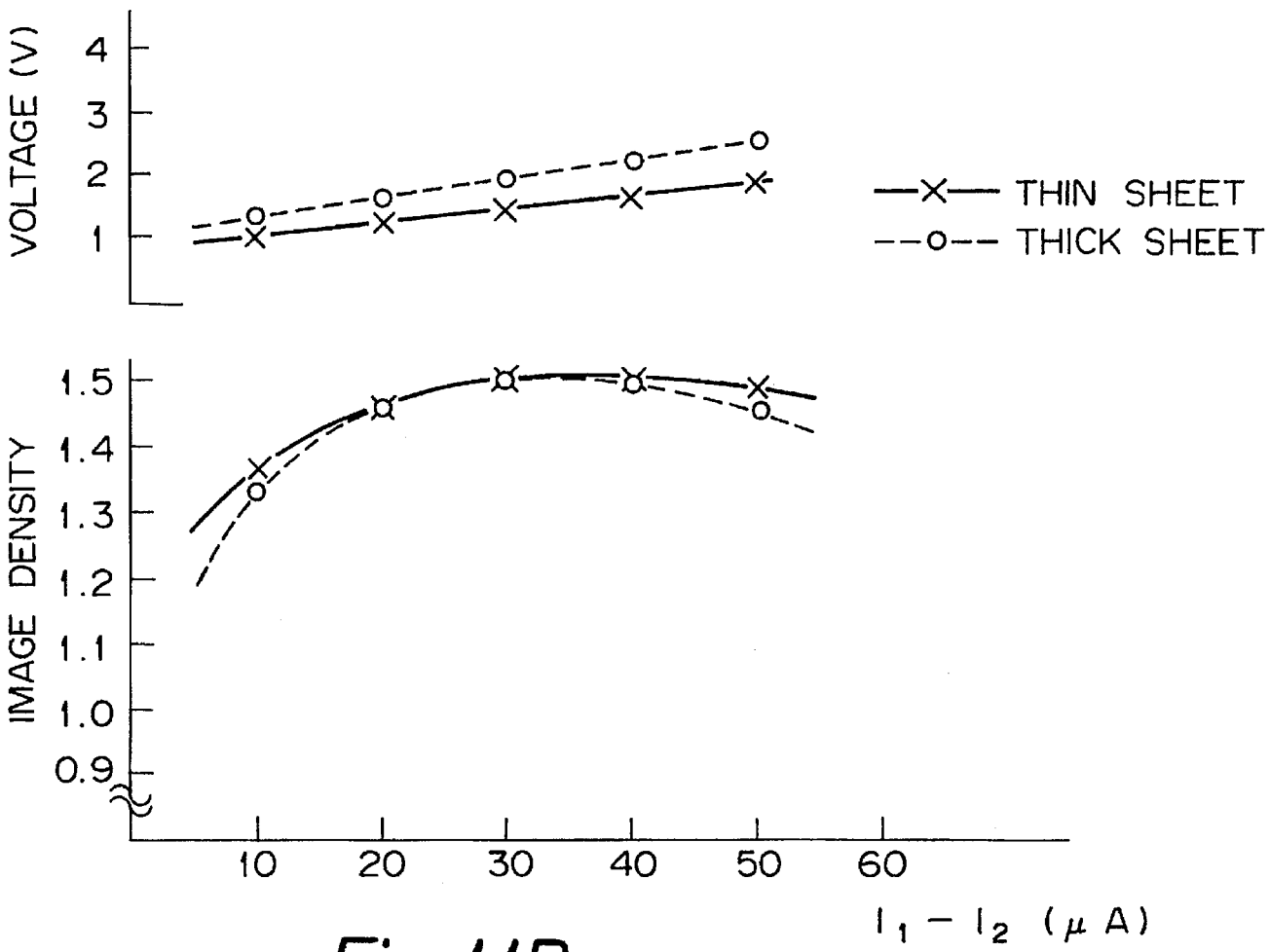
FIG. 11 plots a relation between a current and a voltage and image density with respect to different sheets and also particular to the arrangement of FIG. 8.
Figures 12A, 12B:
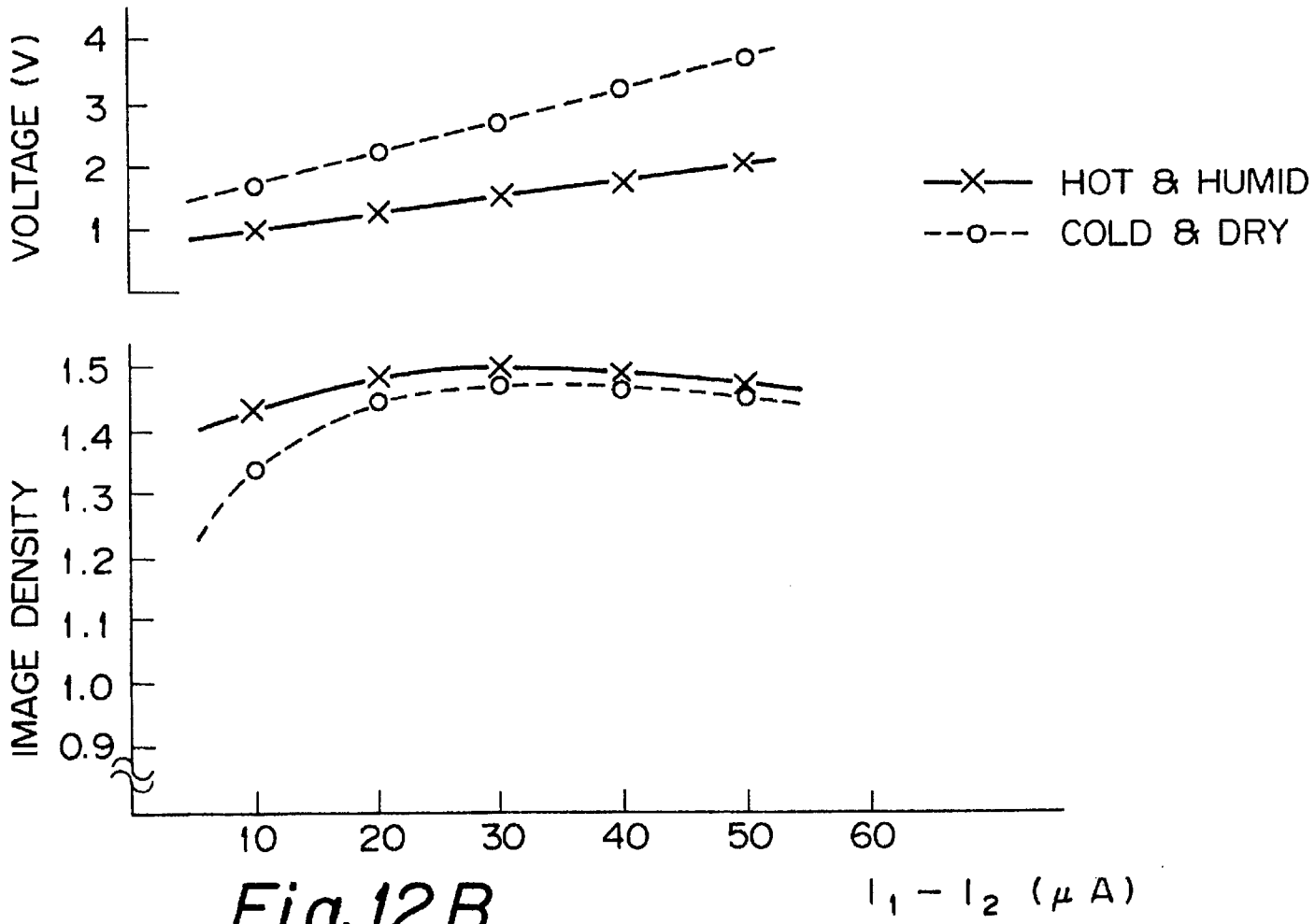
FIG. 12 plots a relation between a current and a voltage and image density with respect to different environments and also particular to the arrangement of FIG. 8.

FIGS. 10–12 show experimental data for supplementing the above description of the operation. In the figures, the abscissa and the ordinate indicate respectively the difference between the currents $I_1$ and $I_2$ and the voltage applied to the belt 23 together with image density. Specifically, in FIG. 10, dotted curves and solid curves indicate respectively data derived from belts A and B each having a particular resistance.

FIG. 11 is indicative of a relation between the difference between the currents $I_1$ and $I_2$ and the voltage and image density. Solid curves and dotted curves are respectively associated with a thin sheet and a thick sheet each having a particular conductivity characteristic.

FIG. 12 shows a relation between the difference between the currents $I_1$ and $I_2$ and the voltage and image density with respect to different environments. Solid curves and dotted curves are respectively associated with a high temperature and high humidity environment and a low temperature and low humidity environment.

The driven roller 22 is provided with a diameter as small as about 14 mm to 16 mm, as stated earlier. Hence, the sheet carrying an image transferred from the drum 20 and being transported by the belt 23 is separated from the belt 23 due to its own elasticity and then driven out to the left. The separation of the sheet from the belt 23 is further enhanced since, as the sheet moves away from the drum 20, the charge on the belt 23 is dissipated due to the conductivity of the belt 23. When the sheet moves away from the nip portion of the drum 20, the solenoid 31 is deenergized to lower the lever 29. As a result, the belt 23 is moved away from the drum 20 to protect the drum 20 from deterioration.

If desired, a particular range of voltage which the power source 27 can apply may be set, and means for detecting a change in the voltage may be provided. Then, when the voltage is brought out of the particular range, alarm means, not shown, may produce an alarm. Specifically, when a leak occurs at a location other than between the power source 26 and the associated member or when the current fails to flow to the belt 23, the detecting means will detect such an occurrence and cause the alarm means to produce and alarm.

Figure 13:
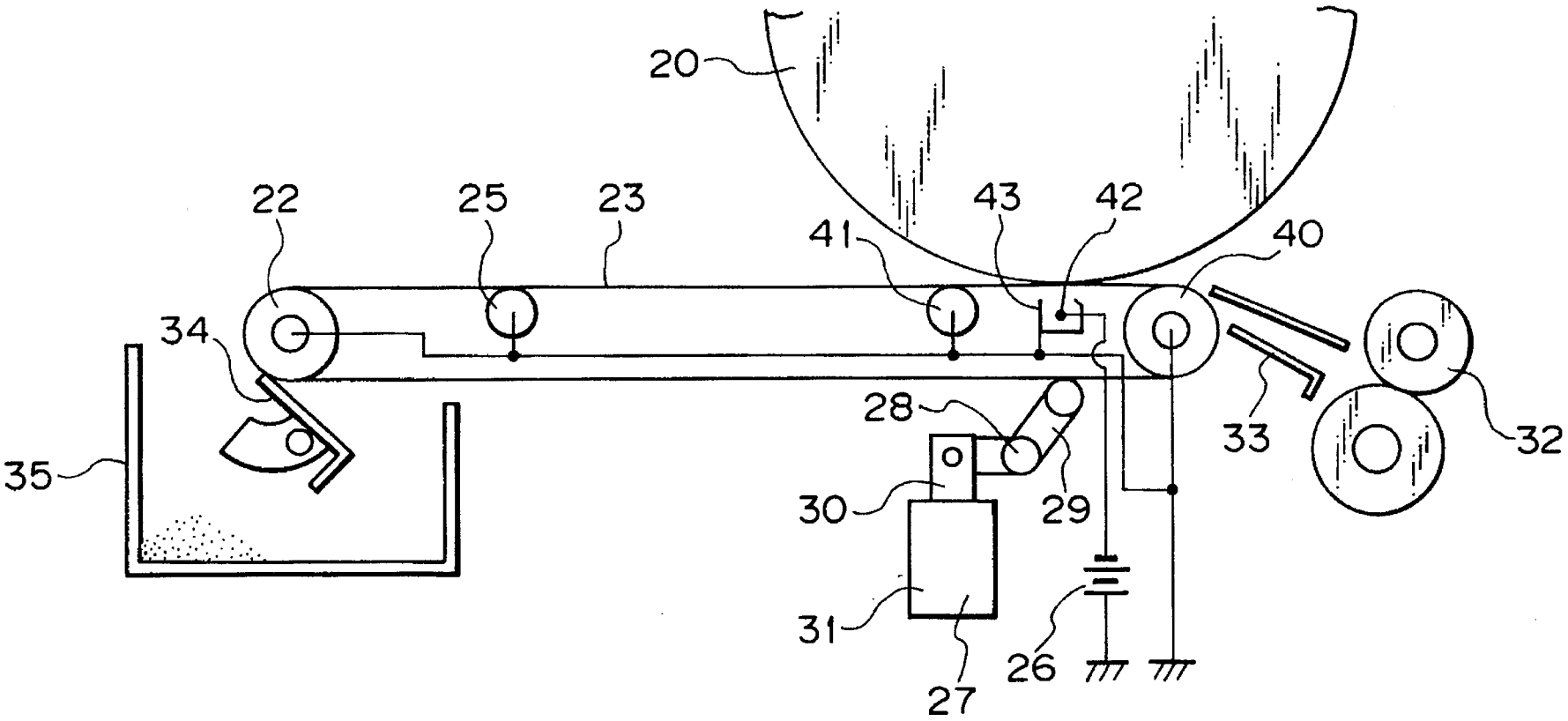
FIG. 13 is a section showing a modification of the arrangement of FIG. 8.

FIG. 13 shows a structure using a corona charger 42 for charging the belt 23. As shown, the belt 23 is driven by a driven roller 40. A roller 41 supports the belt 23 in the vicinity of the drum 20. The rollers 40 and 41 are made of a conductive material and connected to ground together with the driven roller 22 and roller 25. The corona charger 42 faces the inner surface of the belt 23 immediately below the drum 20 and has a wire and a casing 43. The wire is connected to the power source 26 while the casing 43 is connected to ground.

Figure 14:
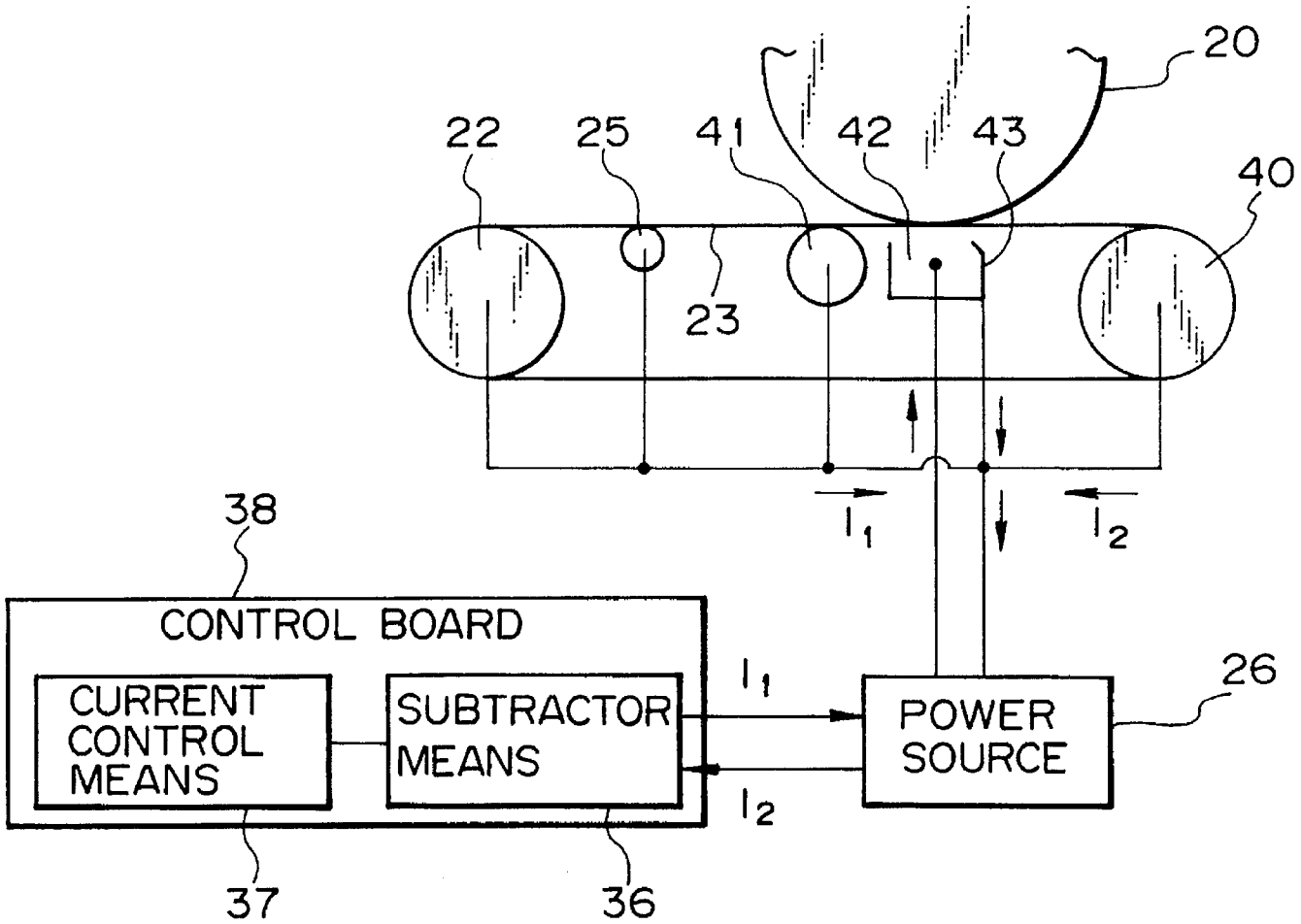
FIG. 14 is a schematic block diagram associated with FIG. 13.

As shown in FIG. 14, assume that a current $I_1$ is fed from the power source 26 to the wire of the corona charger 42, and that the sum of the current to flow from the casing 43 to ground and the current to flow from the belt 23 to ground via the rollers 22, 25, 40 and 41 is $I_2$. The control board 38 has the subtractor means 36 for subtracting $I_2$ from $I_1$, and the current control means 37 for controlling the current from the power source 26 to the corona charger 42 such that the residual remains constant (30 μA).

In operation, as a sheet is transported by the drum 20 and belt 23, the corona charger 42 effects a discharge toward the belt 23 to deposit a charge on the belt 23. At this instant, since the belt 23 has a resistance of 9 to $9.8\times10^7$ Ω, the charge is prevented from being immediately released to ground. Hence, a charge required for image transfer can be deposited on the belt 23 in the vicinity of the drum 20. Moreover, the current control means 37 controls the current from the power source 26 to the corona charger 42 such that the difference between the current I1 flown to the wire of the charger 42 and the currents I2 to flow from the casing 43 and belt 23 to ground remains constant. It follows that although the resistance of the belt 23 may change, the charge to be deposited from the belt 23 on the drum 20 can be maintained constant to in turn maintain the charge required for image transfer substantially constant between the drum 20 and the belt 23. As a result, the quality of a transferred image is enhanced.

The operation described above is also proved by the data shown in FIGS. 10–12. In this embodiment, the voltage and current shown in FIGS. 10–12 are similarly applicable to the corona charger 32. Regarding the effects, this embodiment is substantially comparable with the previous embodiment.

In summary, the present invention provides a guide for determining a positional relation between members constituting an image transferring device as well as the materials of such members, and positions the members on the basis of the guide. Hence, when a transfer bias for setting the surface potential of a sheet is applied, there are eliminated the dielectric breakdown of a photoconductive element and that of a transfer belt and noise otherwise introduced in electric control circuitry. It follows that the transfer bias and discharge for preventing a sheet from wrapping around the photoconductive element and from being incompletely separated from the transfer belt can function effectively.

In accordance with the present invention, current control means controls a current from a power source to a contact electrode such that a current to flow from the transfer belt to the photoconductive element remains constant. Therefore, a charge required for substantial image transfer is maintained constant between the photoconductive element and the transfer belt although various factors including the environment, the property of a sheet, the resistance of the transfer belt and the area of an image may change. This enhances the quality of image transfer. Moreover, since the contact electrode used to achieve such an advantage is located at a position where a charge is not injected into a sheet before the sheet reaches the photoconductive element, the transfer of the true charge to the sheet is delayed to prevent the sheet from wrapping around the photoconductive element and from being incompletely separated.

Furthermore, the current control means controls the current from the power source to the contact electrode such that a difference between a current to the transfer belt and a current to ground remains constant. Therefore, despite that the resistance of the belt may change, a charge required for substantial image transfer is maintained constant between the photoconductive element and the transfer belt. Since a contact member is provided for detecting a current to flow to ground, it is possible to determine a current to the transfer belt and a current to ground with accuracy.

In addition, a particular range of voltage which the power source can apply may be set in order to produce an alarm when the voltage does not lie in such a range. This surely eliminates an occurrence that no current is fed to the transfer belt to render the image transfer defective.

Various modifications will become possible for those skilled in the art after receiving the teachings of the present disclosure without departing from the scope thereof.

What is claimed is:

1. A device incorporated in an image forming apparatus for transferring an image from a photoconductive element to a sheet, comprising:

a transfer belt made of a dielectric material and contacting a surface of the photoconductive element;

supporting means supporting a drive roller and a driven roller over which said transfer belt is passed;

sheet transporting means for transporting the sheet to between the photoconductive element and said transfer belt; and contact electrode means connected to a high-tension power source and directly contacting said transfer belt in the vicinity of the photoconductive element;

wherein a distance between said driven roller adjoining the photoconductive element and a nip portion where said photoconductive element and said transfer belt face each other is $L_1$, and a voltage to be applied from said high-tension power source to said contact electrode means is $V_O$, said distance $L_1$ being selected to satisfy a relation:

$$L_1 \geqq \alpha|V_O|$$

where $\alpha$ is 1.0 (mm/kV).

2. A device as claimed in claim 1, wherein said drive roller is made of an insulating material.

3. A device as claimed in claim 1, wherein said driven roller comprises a conductive roller held in an electrically floating state.

4. The device of claim 1, wherein a distance between said nip portion and said contact electrode is $L_2$, said distance $L_2$ being selected to satisfy a relation:

$$L_2 \geqq a|V_O|$$

where a is 1.0 (mm/kV).

5. The device of claim 4, further including a first discharge element located downstream from said contact electrode by a distance $L_3$, and wherein $L_3$ is selected to satisfy a relation:

$$L_3 \geqq L_2.$$

6. The device of claim 5, further including a second discharge element located downstream from said first discharge element by a distance $L_4$, and wherein said transfer belt has a time constant $\tau$ and a process speed $v$, said distance $L_4$ being selected to satisfy a relation:

$$\tau \leqq L_4/v.$$

7. A device incorporated in an image forming apparatus for transferring an image from a photoconductive element to a sheet, comprising:

a transfer belt made of a dielectric material and contacting a surface of the photoconductive element;

supporting means supporting a drive roller and a driven roller over which said transfer belt is passed;

sheet transporting means for transporting the sheet to between the photoconductive element and said transfer belt; and contact electrode means connected to a high-tension power source and directly contacting said transfer belt in the vicinity of the photoconductive element;

wherein a distance between a nip portion where the photoconductive element and said transfer belt face each other and said contact electrode means is $L_2$, and a voltage to be applied from said high-tension power source to said contact electrode means is $V_O$, said distance $L_2$ being selected to satisfy a relation:

$$L_2 \geqq a|V_O|$$

where $\alpha$ is 1.0 (mm/kV).

8. A device incorporated in an image forming apparatus for transferring an image from a photoconductive element to a sheet, comprising:

a transfer belt made of a dielectric material and contacting a surface of the photoconductive element;

supporting means supporting first and second rollers over which said transfer belt is passed, said first roller located upstream of a nip portion between the transfer belt and the photoconductive element, and said second roller located downstream of the nip portion between the transfer belt and the photoconductive element;

sheet transporting means for transporting the sheet to between the photoconductive element and said transfer belt;

contact electrode means connected to a high-tension power source and directly contacting said transfer belt in the vicinity of the photoconductive element; and discharging means located downstream of said contact electrode means and upstream of said second roller with respect to an intended direction of movement of said transfer belt for dissipating a charge of said transfer belt, said discharging means comprising first and second contact elements;

wherein a distance between said first and second contact elements is $L_4$, and said transfer belt has a time constant $\tau$ and a process speed $v$, said distance $L_4$ being selected to satisfy a relation:

$$\tau \leqq L_4/v.$$

9. The device of claim 8, wherein said first and second contact elements are contact plates.

10. A device incorporated in an image forming apparatus for transferring an image from a photoconductive element to a sheet, comprising:

a transfer belt made of a dielectric material and contacting a surface of the photoconductive element;

supporting means supportinq a drive roller and a driven roller over which said transfer belt is passed;

sheet transporting means for transporting the sheet to between the photoconductive element and said transfer belt;

contact electrode means connected to a high-tension power source and directly contacting said transfer belt in the vicinity of the photoconductive element; and discharging means located downstream of said contact electrode means with respect to an intended direction of movement of said transfer belt for dissipating a charge of said transfer belt, said discharging means comprising first and second contact plates located inside of said transfer belt;

wherein a distance between a nip portion where the photoconductive element and said transfer belt face each other and said contact electrode means is $L_2$, and a distance between said contact electrode means and at least one of said first and second contact plates is $L_3$, said distance $L_3$ being selected to satisfy a relation:

$L_3 \geqq L_2$; and wherein a distance between said first and second contact plates is $L_4$, and said transfer belt has a time constant $\tau$ and a process speed v, said distance $L_4$ being selected to satisfy a relation:

$$\tau \leqq L_4/v.$$

11. A device incorporated in an image forming apparatus for transferring an image from a photoconductive element to a sheet, comprising:

a transfer belt made of a dielectric material and contacting a surface of the photoconductive element;

supporting means supporting first and second rollers over which said transfer belt is passed, said first roller located upstream of a nip portion between the transfer belt and the photoconductive element, and said second roller located downstream from the nip portion between the transfer belt and the photoconductive element;

sheet transporting means for transporting the sheet to between the photoconductive element and said transfer belt;

contact electrode means connected to a high-tension power source and directly contacting said transfer belt in the vicinity of the photoconductive element; and discharging mens located downstream of said contact electrode means and upstream of said second roller with respect to an intended direction of movement of said transfer belt for dissipating a charge of said transfer belt, said discharging means comprising a contact element located inside of said transfer belt;

wherein said contact electrode means is located downstream of a nip portion between said photoconductive element and said transfer belt, and wherein a distance between said nip portion and said contact electrode means is $L_2$ and that a voltage to be applied from said high-tension power source to said contact electrode means is $V_O$, said distance $L_2$ being selected to satisfy a relation:

$$L_2 \geqq a|V_O|;$$

and wherein a distance between said contact electrode means and said discharging means is $L_3$, said distance $L_3$ being selected to satisfy a relation:

$$L_3 \geqq L_2.$$

12. The device of claim 11, wherein said contact element is a contact plate.

13. A device incorporated in an image forming apparatus for transferring an image from a photoconductive element to a sheet, comprising:

a transfer belt made of a dielectric material and contacting a surface of the photoconductive element;

supporting means supporting a drive roller and a driven roller over which said transfer belt is passed;

sheet transporting means for transporting the sheet to between the photoconductive element and said transfer belt;

contact electrode means connected to a high-tension power source and directly contacting said transfer belt in the vicinity of the photoconductive element; and transfer current control means for controlling a current to be fed from said high-tension power source such that a current to flow from said transfer belt to the photoconductive element remains constant;

said transfer belt having a double layer structure made up of an outer layer having a surface resistivity of $1\times10^9$ Ω to $1\times10^{12}$ Ω and an inner layer having a surface resistivity of $8\times10^6$ Ω to $8\times10^8$ Ω and a volume resistivity of $5\times10^8$ Ω.cm to $5\times10^{10}$ Ω.cm.

14. A device incorporated in an image forming apparatus for transferring an image from an image bearing member to a sheet, comprising:

a transfer belt contacting a surface of the image bearing member to thereby form a nip portion between said transfer belt and the image bearing member, said nip portion having a predetermined width, said transfer belt having an electric resistance of $10^9\Omega$ to $10^{12}\Omega$ at a surface of said transfer belt which contacts said surface of the image bearing member;

supporting means supporting rotatable members over which said transfer belt is passed;

sheet transporting means for transporting the sheet to said nip portion;

contact electrode means located downstream of said nip portion and directly contacting an inner surface of said transfer belt for applying a transfer charge to said transfer belt; and a power source connected to said contact electrode means so that a transfer current is fed from said power source to said contact electrode means;

the device further including a discharge member spaced from said contact electrode means by a distance $L_3$, wherein said contact electrode means is spaced from said nip portion by a distance $L_2$, and wherein $L_3 \geqq L_2$.

15. A device as claimed in claim 14, wherein the discharge member is located between said contact electrode means and one of said rotatable members of said supporting means located at a position which is nearest to said nip portion downstream of said contact electrode means and directly contacts said transfer belt for dissipating said transfer charge of said transfer belt which is applied by said contact electrode means.

16. A device as claimed in claim 15, wherein a plurality of discharge members are located inside of said transfer belt.

17. A device as claimed in claim 15, wherein a plurality of discharge members are located inside of said transfer belt, at least one of which comprises said supporting means.

18. A device incorporated in an image forming apparatus for transferring an image from an image bearing member to a sheet, comprising:

a transfer belt contacting a surface of the image bearing member to thereby form a nip portion between said transfer belt and the image bearing member, said nip portion having a predetermined width;

supporting means supporting rotatable members over which said transfer belt is passed;

sheet transporting means for transporting the sheet to said nip portion;

contact electrode means located downstream of said nip portion and directly contacting an inner surface of said transfer belt for applying a transfer charge to said transfer belt such that said nip portion is not overlapped by a contact portion where said contact electrode means contacts said inner surface of said transfer belt;

a power source connected to said contact electrode means so that a transfer current is fed from said power source to said contact electrode means;

discharge means located between said contact electrode means and one of said rotatable members of said supporting means located at a position which is nearest to said nip portion downstream of said contact electrode means and directly contacts said transfer belt for dissipating said transfer charge of said transfer belt which is applied by said contact electrode means; and control means for controlling said power source such that said transfer current from said power source is selected to satisfy a relation:

$$I_1-I_2=I_{OUT}$$

where $I_1$ is said transfer current, $I_2$ is a feedback current flowing from said discharge means to ground via said transfer belt, and $I_{OUT}$ is constant, where a distance between said nip portion and said contact electrode means is $L_2$ and a distance between said contact electrode means and said discharge means is $L_3$, said distance $L_3$ being selected to satisfy a relation:

$$L_3 \geqq L_2.$$

19. A device as claimed in claim 18, wherein said $I_{OUT}$ corresponds to a current flowing from said contact electrode means to the image bearing means via said transfer belt.

20. A device incorporated in an image forming apparatus for transferring an image from an image bearing member to a sheet, comprising:

a transfer belt contacting a surface of the image bearing member to thereby form a nip portion between said transfer belt and the image bearing member, said nip portion having a predetermined width, said transfer belt having an electric resistance of $10^6\Omega$ to $10^{12}\Omega$ at a surface of said transfer belt which contacts said surface of the image bearing member;

a supporter supporting rotatable members over which said transfer belt is passed;

a sheet transporter which transports the sheet to said nip portion;

a contact electrode located downstream of said nip portion and directly contacting an inner surface of said transfer belt for applying a transfer charge to said transfer belt; and a power source connected to said contact electrode so that a transfer current is fed from said power source to said contact electrode;

the device further including a discharge member spaced from said contact electrode means by a distance $L_3$, wherein said contact electrode means is spaced from said nip portion by a distance $L_2$, and wherein $L_3 \geqq L_2$.

21. A device as claimed in claim 20, wherein a plurality of discharge members are located inside of said transfer belt.

22. A device as claimed in claim 20, wherein a plurality of discharge members are located inside of said transfer belt, at least one of which comprises said supporter.

23. A device incorporated in an image forming apparatus for transferring an image from an image bearing member to a sheet, comprising:

a transfer belt contacting a surface of the image bearing member to thereby form a nip portion between said transfer belt and the image bearing member;

a supporter supporting rollers over which said transfer belt is passed;

an electrode located at at least one position which is disposed at one of an upstream location and a downstream location with respect to the nip portion and directly contacting said transfer belt for applying a transfer charge to said transfer belt;

a power source connected to said electrode so that a transfer current is fed from said power source to said electrode;

a discharger located downstream of the nip portion with respect to an intended direction of movement of said transfer belt for dissipating said transfer charge of said transfer belt which is applied by said electrode, said discharger including at least one discharge member; and a controller which controls said power source such that said transfer current from said power source is selected to satisfy a relation:

$$I_1-I_2=I_{OUT}$$

where $I_1$ is said transfer current, $I_2$ is a feedback current flowing from said discharger to ground via said transfer belt, and $I_{OUT}$ is constant, wherein a distance between said nip portion and said electrode is $L_2$ and a distance between said electrode and said one discharge member is $L_3$, said distance $L_3$ being selected to satisfy a relation:

$$L_3 \geqq L_2.$$

24. A device incorporated in an image forming apparatus for transferring an image from an image bearing member to a sheet, comprising:

an endless transfer member contacting a surface of the image bearing member to thereby form a nip portion between said endless transfer member and the image bearing member;

a supporter supporting rollers over which said endless transfer member is passed;

an electrode directly contacting said endless transfer member for applying a transfer charge to said endless transfer member;

a power source connected to said electrode so that a transfer current is fed from said power source to said electrode;

a discharger which dissipates said transfer charge of said endless transfer member which is applied by said electrode, said discharger including at least one discharge member;

a controller which controls said power source such that said transfer current from said power source is selected to satisfy a relation:

$$I_1-I_2=I_{OUT}$$

where $I_1$ is said transfer current, $I_2$ is a feedback current flowing from said discharger to ground via said transfer member, and $I_{OUT}$ is constant; and an urging mechanism which urges said endless transfer member against the image bearing member;

wherein a distance between said nip portion and said electrode is $L_2$ and a distance between said electrode and said one discharge member is $L_3$, said distance $L_3$ being selected to satisfy a relation:

$$L_3 \geqq L_2.$$

25. A device as claimed in claim 24, wherein said urging mechanism moves said endless transfer member into and out of contact with the image bearing member.

26. A device as claimed in claim 25, wherein said urging mechanism urges a portion of said endless transfer member which is disposed below the nip portion.

27. A device as claimed in claim 25, wherein said urging mechanism urges a portion of said endless transfer member which is disposed downstream of the nip portion with respect to an intended direction of movement of said endless transfer member.

28. A device as claimed in claim 24, wherein said endless transfer member comprises an endless belt which constitutes a unit together with said electrode and said rollers supported by said supporter.

29. A device incorporated in an image forming apparatus for transferring an image from a photoconductive element to a sheet, comprising:

a transfer belt contacting a surface of the photoconductive element;

a supporter supporting first and second rollers over which said transfer belt is passed, said first roller being located upstream of a nip portion between the transfer belt and the photoconductive element, said second roller being located downstream of the nip portion between the transfer belt and the photoconductive element;

a sheet transporter which transports the sheet to said transfer belt; and a contact electrode connected to a high-tension power source and directly contacting said transfer belt in the vicinity of the photoconductive element;

wherein a distance between said first roller adjoining the photoconductive element and the nip portion is $L_1$, and a voltage to be applied from said high-tension power source to said contact electrode is $V_O$, said distance $L_1$ being selected to satisfy a relation:

$$L_1 \geqq a|V_O|$$

where a is 1.0 (mm/kV).

30. A device as claimed in claim 29, wherein said second roller is made of an insulating material.

31. A device as claimed in claim 29, wherein said first roller comprises a conductive roller held in an electrically floating state.

32. A device as claimed in claim 29, wherein a distance between said nip portion and said contact electrode is $L_2$, said distance $L_2$ being selected to satisfy a relation:

$$L_2 \geqq a|V_O|$$

where a is 1.0 (mm/kV).

33. A device as claimed in claim 32, further comprising a first discharge element located downstream from said contact electrode by a distance $L_3$, and wherein $L_3$ is selected to satisfy a relation:

$$L_3 \geqq L_2.$$

34. A device as claimed in claim 33, further comprising a second discharge element located downstream from said first discharge element by a distance $L_4$, and wherein said transfer belt has a time constant $\tau$ and a process speed $v$, said distance $L_4$ being selected to satisfy a relation:

$$\tau \leqq L_4/v.$$

35. A device incorporated in an image forming apparatus for transferring an image from a photoconductive element to a sheet, comprising:

a transfer belt contacting a surface of the photoconductive element;

a supporter supporting first and second rollers over which said transfer belt is passed, said first roller being located upstream of a nip portion between the transfer belt and the photoconductive element, said second roller being located downstream of the nip portion between the transfer belt and the photoconductive element;

a sheet transporter which transports the sheet to said transfer belt; and a contact electrode connected to a high-tension power source and directly contacting said transfer belt in the vicinity of the photoconductive element;

wherein a distance between the nip portion and said contact electrode is $L_2$, and a voltage to be applied from said high-tension power source to said contact electrode is $V_O$, said distance $L_2$ being selected to satisfy a relation:

$$L_2 \geqq a|V_O|$$

where a is 1.0 (mm/kV).

36. A device incorporated in an image forming apparatus for transferring an image from a photoconductive element to a sheet, comprising:

a transfer belt contacting a surface of the photoconductive element;

a supporter supporting first and second rollers over which said transfer belt is passed, said first roller being located upstream of a nip portion between the transfer belt and the photoconductive element, said second roller being located downstream of the nip portion;

a sheet transporter which transports the sheet to said transfer belt;

a contact electrode connected to a high-tension power source and directly contacting said transfer belt in the vicinity of the photoconductive element; and a discharger located downstream of said contact electrode with respect to an intended direction of movement of said transfer belt for dissipating a charge of said transfer belt, said discharger comprising first and second contact elements;

wherein a distance between said first and second contact elements is $L_4$, and said transfer belt has a time constant $\tau$ and a process speed $v$, said distance $L_4$ being selected to satisfy a relation:

$$\tau \leqq L_4/v.$$

37. A device as claimed in claim 36, wherein said first and second contact elements are contact plates.

38. A device incorporated in an image forming apparatus for transferring an image from a photoconductive element to a sheet, comprising:

a transfer belt contacting a surface of the photoconductive element;

a supporter supporting first and second rollers over which said transfer belt is passed, said first roller being located upstream of a nip portion between the transfer belt and the photoconductive element, said second roller being located downstream of the nip portion between the transfer belt and the photoconductive element;

a sheet transporter which transports the sheet to said transfer belt;

a contact electrode connected to a high-tension power source and directly contacting said transfer belt in the vicinity of the photoconductive element; and a discharger located downstream of said contact electrode with respect to an intended direction of movement of said transfer belt for dissipating a charge of said transfer belt, said discharger comprising first and second contact members located inside of said transfer belt;

wherein a distance between the nip portion and said contact electrode is $L_2$, and a distance between said electrode and at least one of said first and second contact members is $L_3$, said distance $L_3$ being selected to satisfy a relation:

$$L_3 \geqq L_2; \text{ and}$$

wherein a distance between said first and second contact members is $L_4$, and said transfer belt has a time constant $\tau$ and a process speed $v$, said distance $L_4$ being selected to satisfy a relation:

$$\tau \leqq L_4/v.$$

39. A device incorporated in an image forming apparatus for transferring an image from a photoconductive element to a sheet, comprising:

a transfer belt contacting a surface of the photoconductive element;

a supporter supporting first and second rollers over which said transfer belt is passed, said first roller being located upstream of a nip portion between the transfer belt and the photoconductive element, said second roller being located downstream from the nip portion;

a sheet transporter which transports the sheet to said transfer belt;

a contact electrode connected to a high-tension power source and directly contacting said transfer belt in the vicinity of the photoconductive element; and a discharger located downstream of said contact electrode with respect to an intended direction of movement of said transfer belt for dissipating a charge of said transfer belt, said discharger comprising a contact element located inside of said transfer belt;

wherein said contact electrode is located downstream of the nip portion, and wherein a distance between said nip portion and said contact electrode is $L_2$ and a voltage to be applied from said high-tension power source to said contact electrode is $V_O$, said distance $L_2$ being selected to satisfy a relation:

$$L_2 \geqq a|V_O|$$

and wherein a distance between said contact electrode and said discharger is $L_3$, said distance $L_3$ being selected to satisfy a relation:

$$L_3 \geqq L_2.$$

40. A device as claimed in claim 39, wherein said contact element is a contact plate.

41. An image transfer device incorporated in an image forming apparatus having an image bearing member, comprising:

an endless transfer member contacting a surface of the image bearing member;

a supporter movably supporting said endless transfer member; and a contact electrode connected to a high-tension power source and directly contacting said transfer member in the vicinity of the image bearing member;

said transfer member having a double layer structure made up of an outer layer having a first surface resistivity of $1\times10^9\Omega$ to $1\times10^{12}\Omega$ and an inner layer having a second surface resistivity of $8\times10^6\Omega$ to $8\times10^8\Omega$ and a volume resistivity of $5\times10^8$ $\Omega$cm to $5\times10^{10}$ $\Omega$cm.

42. A device incorporated in an image forming apparatus for transferring an image from an image bearing member to a sheet, comprising:

a transfer belt contacting a surface of the image bearing member to thereby form a nip portion between said transfer belt and the image bearing member, said nip portion having a predetermined width;

a supporter supporting rotatable members over which said transfer belt is passed;

a sheet transporter which transports the sheet to said nip portion;

a contact electrode located downstream of said nip portion and directly contacting an inner surface of said transfer belt for applying a transfer charge to said transfer belt;

a power source connected to said contact electrode so that a transfer current is fed from said power source to said contact electrode;

a discharger directly contacting said transfer belt for dissipating said transfer charge of said transfer belt which is applied by said contact electrode, said discharger including at least one discharge member; and a controller which controls said power source such that said transfer current from said power source is selected to satisfy a relation:

$$I_1 - I_2 = I_{OUT}$$

where $I_1$ is said transfer current, $I_2$ is a feedback current flowing from said discharger to ground via said transfer belt, and $I_{OUT}$ is constant, wherein a distance between said nip portion and said electrode is $L_2$ and a distance between said electrode and said one discharge member is $L_3$, said distance $L_3$ being selected to satisfy a relation:

$$L_3 \geqq L_2.$$

43. A device as claimed in claim 42, wherein said discharger comprises a discharge member located inside of said transfer belt.

44. A device as claimed in claim 42, wherein said discharger comprises a plurality of discharge members located inside of said transfer belt.

45. A device as claimed in claim 42, wherein said discharger comprises a discharge member located inside of said transfer belt and contacting an inner surface of a lower run of said transfer belt which is opposite to an upper run for carrying the sheet.

46. A device as claimed in claim 42, wherein said corresponds to a current flowing from said contact electrode to the image bearing member via said transfer belt.

47. A device incorporated in an image forming apparatus for transferring an image from an image bearing member to a sheet, comprising:

a transfer belt contacting a surface of the image bearing member to thereby form a nip portion between said transfer belt and the image bearing member, said nip portion having a predetermined width;

a supporter supporting rotatable members over which said transfer belt is passed;

a sheet transporter which transports the sheet to said nip portion;

a contact electrode located downstream of said nip portion and directly contacting an inner surface of said transfer belt for applying a transfer charge to said transfer belt such that said nip portion is not overlapped by a contact portion where said contact electrode contacts said inner surface of said transfer belt;

a power source connected to said contact electrode so that a transfer current is fed from said power source to said contact electrode;

a discharger directly contacting said transfer belt for dissipating said transfer charge of said transfer belt which is applied by said contact electrode; and a controller which controls said power source such that said transfer current from said power source is selected to satisfy a relation:

$$I_1 - I_2 = I_{OUT}$$

where $I_1$ is said transfer current, $I_2$ is a feedback current flowing from said discharger to ground and $I_{OUT}$ is constant, wherein a distance between said nip portion and said contact electrode is $L_2$ and a distance between said contact electrode and said discharger is $L_3$, said distance $L_3$ being selected to satisfy a relation:

$$L_3 \geqq L_2.$$

48. A device as claimed in claim 47, wherein said $I_{OUT}$ corresponds to a current flowing from said contact electrode to the image bearing member via said transfer belt.

49. An image transfer device incorporated in an image forming apparatus having an image carrier on which a toner image is formed, comprising:

a movable endless transfer member contacting the image carrier, a nip portion being formed between said transfer member and the image carrier;

a supporter movably supporting said movable endless transfer member;

a contact electrode located downstream of said transfer member and directly contacting said transfer member for transferring said toner image on the image carrier toward said transfer member by applying a transfer voltage to said transfer member; and a power source connected to said contact electrode;

wherein a distance between the nip portion and said contact electrode is $L_2$, and a voltage to be applied from said power source to said contact electrode is $V_O$, said distance $L_2$ being selected to satisfy a relation:

$$L_2 \geqq a|V_O|$$

where a is 1.0 (mm/kV).

* * * * *